US011393268B2

(12) United States Patent
Cartwright

(10) Patent No.: US 11,393,268 B2
(45) Date of Patent: Jul. 19, 2022

(54) SECURE ACCESS LOCKER BANKS

(71) Applicant: ILLINOIS TOOL WORKS INC., Glenview, IL (US)

(72) Inventor: Kevin Cartwright, West Midlands (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/061,688

(22) Filed: Oct. 2, 2020

(65) Prior Publication Data

US 2021/0104108 A1 Apr. 8, 2021

(30) Foreign Application Priority Data

Oct. 8, 2019 (GB) ..... 1914526
Sep. 17, 2020 (GB) ..... 2014662

(51) Int. Cl.
*G07C 9/00* (2020.01)
*G07C 9/29* (2020.01)
*E05G 1/08* (2006.01)

(52) U.S. Cl.
CPC ..... *G07C 9/00571* (2013.01); *G07C 9/00563* (2013.01); *G07C 9/00912* (2013.01); *G07C 9/29* (2020.01); *E05G 1/08* (2013.01)

(58) Field of Classification Search
CPC .. G07C 9/00571; G07C 9/29; G07C 9/00563; G07C 9/00912; E05G 1/08
See application file for complete search history.

(56) References Cited

U.S. PATENT DOCUMENTS

| | | | | |
|---|---|---|---|---|
| 2,198,239 | A | 4/1940 | McKinley | |
| 10,957,135 | B2 | 3/2021 | McGehee | |
| 2006/0226979 | A1 | 10/2006 | Mayer | |
| 2009/0224872 | A1* | 9/2009 | Naccache | G07C 11/00 340/5.6 |
| 2012/0206029 | A1 | 8/2012 | Zabbatino | |
| 2020/0349796 | A1* | 11/2020 | Gokcebay | G07C 9/00912 |

FOREIGN PATENT DOCUMENTS

| | | |
|---|---|---|
| AU | 2013203916 | 5/2014 |
| EP | 2375386 A2 | 10/2011 |
| EP | 1366442 B1 | 9/2015 |
| EP | 2950283 | 12/2015 |
| EP | 3550487 | 10/2019 |

(Continued)

*Primary Examiner* — Nabil H Syed
(74) *Attorney, Agent, or Firm* — Thompson Hine LLP

(57) ABSTRACT

A secure storage system for multi-user access having a plurality of lockable storage spaces, and a method for granting or denying access to the plurality of lockable storage spaces. A first subset of the lockable storage spaces is allocated to a first user and a second subset of the lockable storage spaces is allocated to a second user. A first access sequence of lockable storage spaces within the first subset is determined for the first user, and a second access sequence of lockable storage spaces within the second subset is determined for the second user in dependence on a likelihood of an access conflict with the first user. At least one delay period for at least one of the first access sequence and the second access sequence is determined if the likelihood of the access conflict remains above a predetermined threshold.

14 Claims, 9 Drawing Sheets

(56) References Cited

FOREIGN PATENT DOCUMENTS

| | | | |
|---|---|---|---|
| GB | 615167 | | 1/1949 |
| GB | 2407128 | B | 4/2005 |
| GB | 2474118 | B | 4/2011 |
| JP | H07101492 | | 4/1995 |
| JP | H 081492 | | 1/1996 |
| WO | WO 02/07119 | A1 | 1/2002 |
| WO | WO 2015100390 | A1 | 7/2015 |
| WO | WO 2015/114331 | | 8/2015 |
| WO | WO 2017087697 | A1 | 5/2017 |
| WO | WO 2017/163018 | | 9/2017 |

* cited by examiner

Fig.11
Delivery Driver App
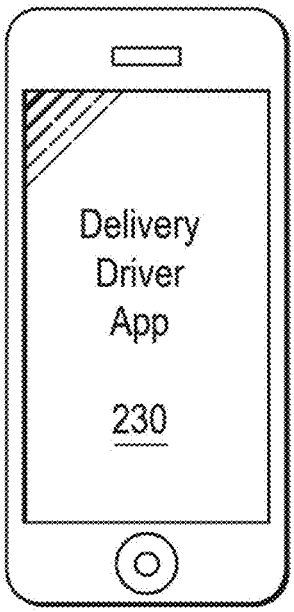
Consumer App
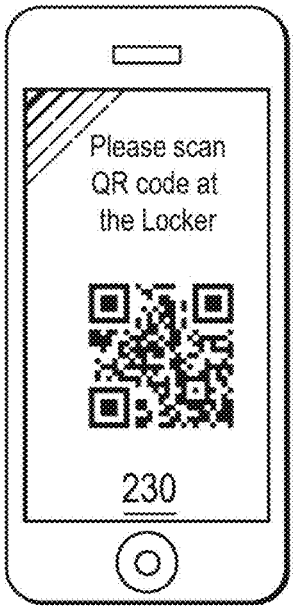
Fig. 12A
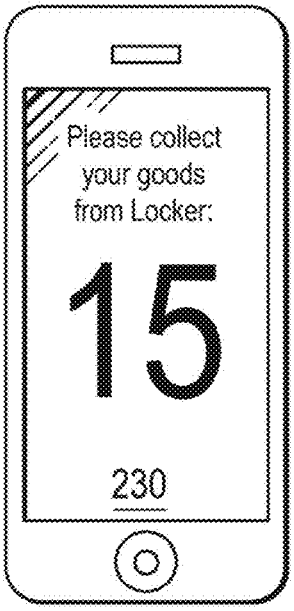
FIG. 12B
Once Locker door 15 is closed, the app will then prompt door 27.
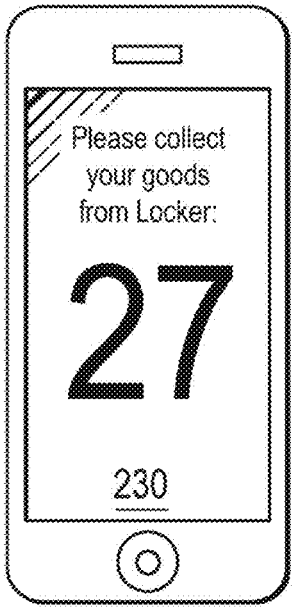
FIG. 12C

SECURE ACCESS LOCKER BANKS

FIELD OF THE INVENTION

The present invention relates to a locker system, particularly although not exclusively, to a multi-user locker system for the storage of goods.

INTRODUCTION

Bricks and mortar retail, i.e. physical shops, can be a convenient way for consumers to purchase goods. However, this form of shopping can be problematic for many consumers due to unhelpful staff, queueing, overcrowding, car-parking, expensive prices, adverse weather and an overall poor shopping experience. The problems are exacerbated at particular times of the year such as the Christmas period and Black Friday, when it is almost expected for shoppers to be cheek-by-jowl. One solution to this is catalogue shopping which allows consumers to purchase goods from the comfort of their home and have their purchases delivered to them. However, as catalogues are infrequently updated (typically every 6 months), goods in rapidly changing markets, such as cellular phones, may not always be readily obtainable. The internet age has eased some of these problems by the development of online retail.

Online shopping was originally expected to address the problem experienced by consumers in physical shops in order to revolutionise the way consumers purchased and received goods. However, due to the logistical issues involved in delivery, online shopping is not without its own drawbacks. For example, many delivery companies only deliver during typical working hours (between 9 am to 5 pm) which is an issue for people who are away from home during these hours. Delivery aversion or concerns can often result in cart abandonment. It is also a concern for the online retailers themselves as a late delivery results in 59% of customers not shopping again with the retailer according to Barclaycard® study in 2014. In addition to these issues, returning goods purchased online can be inconvenient and time-consuming.

One solution to the problem of delivery services for online shoppers and retailers was provided in UK Patent GB2407128B (to Bearbox Limited) and EP1366442B1 and EP2375386A2 (to ByBox Holdings Limited) which relates to a secure access system for the delivery of goods, ordered by a consumer online, to an automated collection point (ACP) which is accessible by the consumer. In GB2407128B, the secure access system comprises a secure unit, and a logistics centre is provided with details of an access to be made to the secure unit. The logistics centre is in communication with a central management system to confirm access details and allow access to the secure unit wherein the secure unit can allow access thereto responsive to use of the access code at a user interface. ACPs are often conveniently placed at locations such as transportation hubs and office clusters so consumers are able to pick up their online shopping on their way home. One problem with this arrangement is that it while it allows the storage of goods in ambient conditions, it is unsuitable for handling goods requiring storage at a controlled temperature, such as chilled or frozen foodstuffs, which deteriorate if stored in ambient conditions for even short periods of time.

Refrigerated locker systems have been used in a wide range of applications: U.S. Pat. No. 2,198,239, GB615167 and US2012/0206029 relate to locker systems for various purposes such as storing agricultural produce in rural areas or lunch/snack storage in urban workplaces. These documents disclose refrigeration systems requiring a supply of air cooled by a central refrigeration unit, the cooled air being circulated around or through a plurality of lockers via suitable conduits to cool the locker contents in the process. Some of the documents disclose the partition walls having apertures to allow air to pass through them to aid circulation of cold air. However, as the chilled air in these locker systems is supplied from the same source there exists no temperature control for each individual locker, and thus all goods are stored at roughly the same temperature. In order to accommodate the three types of conditions (ambient, chilled and frozen) typically required in a grocery store, it would require three distinct sets of lockers which are not in thermal equilibrium with each other. Also, it is inconvenient and time-consuming for the consumer to traverse between different locker sets and to repeatedly input security codes to unlock each locker.

JP7101492 relates to a locker system allowing individual temperature control in each locker by making use of a thermoelectric cooling device operating by the Peltier effect and removing heat across the walls of the locker whilst a fan placed within each locker enhances air circulation to aid heat removal. Another approach to providing a refrigerated locker system is to install a number of preassembled refrigerator units into lockable store spaces in a locker assembly so as to provide each lockable storage space in the locker assembly with its own dedicated preassembled refrigerated unit. An example of such a locker system is described in GB2474118B (to ByBox Holdings Ltd.). A problem with this approach is that each storage space must be ventilated to prevent heat build-up, so each space must be provided with its own fan which leads to lower energy efficiency and higher maintenance costs.

The problem of excessive energy consumption to control the conditions of lockers was addressed in AU 2013203916 (to Coles Supermarkets Australia Pty Ltd) which relates to a refrigerator unit comprising a plurality of compartments that each have a first section that is cooled to a first temperature range and a second section that is cooled to a second temperature range that is lower than the first temperature range, and a plurality of lockable doors as a distributing method for distributing goods ordered by a consumer. Each of the first and second sections have chambers separated by dividers to provide compartments. The dividers have apertures to allow air flow between the compartments within their respective section such that the chambers within their respective section are theoretically in thermal equilibrium with each other. However, this is difficult to achieve when the chambers (lockers) store goods as the air flow may be impeded leading to a temperature gradient across the respective section. Also, as the goods in each compartment are not completely isolated from each other, there is the possibility of cross-contamination between neighbouring lockers. AU 2013203916 also teaches a distribution system which is configured to receive a submitted order from a consumer to generate order data which includes customer details, the ordered goods, and a nominated refrigerator unit from which the goods can be collected. The order data is then transferred to a site where the goods are collated for stowing in at least one electronically unlockable compartment of the refrigerator unit. Access data is then generated for use in unlocking the doors of at least one compartment of the nominated refrigerator unit, and this access data is transferred to the consumer such that when the consumer inputs the access data, the compartment is unlocked so as to allow the consumer to access and collect the goods. One of the problems is that there is no communication between the distribution system and the temperature control, and therefore, more energy may be expended to cool the compartments than is necessary.

Some of the problems encountered in the aforementioned documents were addressed in WO2015114331 (to Illinois Tool Works Inc.) which teaches a temperature controlled lockable storage apparatus wherein the temperature of compartments within a locker is independently controllable to provide either a chilled or frozen temperature. Unlike in JP7101492, the temperature controlled storage apparatus comprises at least one common distribution system that is arranged to be in cooperation with a refrigeration system, said at least one common distribution system distributing a heat transfer fluid to exchange heat with the one or more compartments in each of the plurality of storage spaces. The refrigeration system is a vapour compression refrigeration unit comprising a compressor, a condenser, an expansion valve and an evaporator. A refrigerant is conveyed directly to heat exchangers (evaporators) in the compartments with the use of at least one common distribution system. The advantages of having a common refrigerant distribution system is greatly improved energy efficiency and reduced maintenance costs. As the vapour compression refrigeration unit is not present in the storage spaces, localised ventilation is not needed for heat dissipation. The temperature can be controlled remotely from the lockable storage apparatus by any suitable telecommunication means. Access to the lockable storage spaces is governed by an access control module which communicates with a central control system at a delivery centre such as a supermarket via a communication module and grants access to the lockable storage spaces for authorised users. Additionally, each of the locker modules comprises a controller for controlling the operation of the valves of the common distribution system to adjust the temperature of particular compartments depending on availability of refrigeration capacity. Based on instructions from the central control system, the access control module communicates with the controller located at the locker module to operate the valves according to the temperature requirements of one or more compartments in anticipation of demand from the delivery centre. Therefore, the access control module and/or the control can place one or more compartments in a locker module in a queueing system in preparation for when one or more compartments have reached their desired temperature which frees up refrigeration capacity. Access to each lockable storage space is governed electronically by locking and unlocking the lockable storage space upon verification of a user identity at a local user interface (e.g. a graphical user interface) located at the access control module.

The above documents show that the operation and efficiency of locker collection services has improved over the past few years, however, a problem with all of the current locker bank systems is that they only allow removal of goods for collection by one consumer at a time. This is especially problematic when users need to access more than one locker for a variety of goods that need to be stored in different conditions as this takes considerably more time. As collection from locker banks becomes increasingly popular (in the UK the proportion of customers using this service has increased from 63% in 2014 to 73% in 2015 and to 76% in 2017), the queues are becoming increasingly long, so one of the original drawbacks of bricks and mortar retail has now become a drawback of this form of online shopping.

The current method of collecting orders placed remotely from a locker bank involves the following steps: A first user places an order and receives a confirmation wherein the confirmation can be in the form of a machine-readable medium such as at least one of a linear barcode, matrix barcode or order number. The first user may collect their order at the locker bank by scanning at least one of a linear barcode, matrix barcode or by entering their order number into a console. A second user places an order and receives a confirmation. The second user arrives at the locker bank after the first user, so the second user queues while the first user collects their order. The first user may be directed by a console to a first locker to collect a first part of their order. The first user, having collected the first part of their order, must return to the console and be directed to a second locker to collect the second part of their order. Meanwhile, the second user is waiting. The first user may return to the console having collected the second part of their order to then be directed to a third locker to collect the third part of their order, and so on. The second user is clearly having their time wasted due to the lack of efficiency of the collection means.

Therefore, there is a clear need for speeding up the collection process by eliminating the waiting time that users must endure whilst standing by as an earlier arriving user collects their ordered goods, and minimising the time taken for the user to collect their goods.

SUMMARY OF THE INVENTION

Aspects of the present invention comprise a system and a method as set forth in the appended claims.

BRIEF DESCRIPTION OF THE DRAWINGS

FIG. 11: A schematic view of the Delivery Driver App; a mobile app primarily for couriers.

FIG. 12 (FIGS. 12A-12C): A schematic view of the Consumer App; a mobile app primarily for consumers.

DETAILED DESCRIPTION

Figure 1:
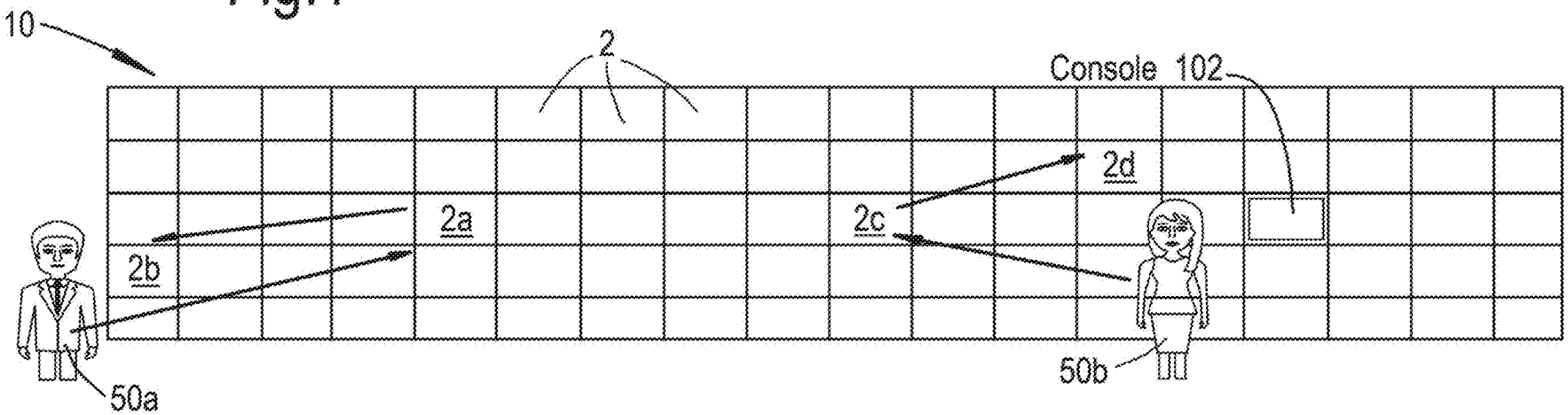
FIG. 1: A schematic view of a locker bank showing how two users may contemporaneously collect their delivered items.

This disclosure describes systems and methods for guiding a user to their allocated lockable storage space(s).

A distribution network is a group of connected storage facilities and transportation systems that receive goods and then deliver them to consumers. A distribution network may comprise a storage installation, wherein the storage installation at a given collection site may comprise a plurality of lockable storage spaces 2, arranged either in a single locker bank 10 on a given footprint at the collection site (see FIG. 1), or in two or more separate locker banks 10 typically grouped close to one another on a given footprint at the collection site (see FIG. 2). This disclosure describes systems and methods for guiding at least one user 50 to their allocated lockable storage space(s) 2, more specifically a subset of a plurality of lockable storage spaces 2 whereby one or more of the storage spaces 2 in the subset allocated to said at least one user stores goods requiring a particular storage condition. Further details of the lockable storage spaces are given later in this disclosure. The user 50 may be a consumer or a courier (delivery person). A consumer may collect goods from a plurality of lockable storage spaces 2 allocated to them. A courier may deliver goods to a plurality of lockable storage spaces 2 allocated to them. Optionally, a consumer may deliver goods to a plurality of lockable storage spaces 2, i.e. in the case of returning the goods. Optionally, a courier may collect goods from a plurality of lockable storage spaces 2 which are returned or uncollected by the consumer. Typically, the communications between the access control system and (i) the courier and (ii) the consumer are a two-way communication in each case. However, in some cases, the communication between the access control system and the consumer or courier may be a one-way communication. Although this disclosure refers frequently to a user (consumer) "collecting" item(s) from a storage space, this phraseology may also apply to a user (courier) "delivering" item(s) to a storage space. Therefore, any reference to a user "collecting" goods from a storage space may also refer to the scenario where a user is "delivering" goods.

In a preferred example of the present invention, the one or more of the lockable storage spaces 2 store goods which require different storage conditions, in particular frozen temperature, chilled temperature and controlled ambient.

For the purpose of the present invention, chilled temperature represents the temperature range for storage of groceries such as milk and yogurt, etc. and covers a range between substantially 0 degrees Celsius to substantially 4° C. The frozen temperature represents the temperature range for storage of frozen groceries such as ice cream and frozen food. For the purpose of the present invention, the frozen temperature covers a range between substantially −25° C. to substantially 0° C., more preferably between substantially −21° C. to substantially −18° C. Preferably, the temperature of each of the one or more compartments is independently controllable to provide any one of ambient or chilled or frozen temperature. The ambient temperature represents the temperature range for storage of typical groceries such as chocolate or dry goods. For the purpose of the present invention, ambient temperature covers a range between substantially 4° C. to substantially 21° C. For the purpose of this invention and all the prior applications, the term "ambient temperature" is construed to mean "room temperature" or more appropriately "controlled ambient temperature". It does not refer to the actual air temperature of the surrounding environment, for example the sub-zero temperature experienced during the winter months; rather "ambient temperature" means a temperature range suitable for storing goods that do not require refrigerated storage to remain in saleable condition.

Each of the lockable storage spaces 2 may comprise a lockable door 11 (FIGS. 8 and 9) actuated by an access control system 100 (FIG. 10) to permit a user 50 to gain access to at least one of a subset of a plurality of lockable storage spaces 2. Different access control systems 100 commonly known in the art are permissible in the present invention. Commonly known access control system are through the use of barcodes or machine readable media. A user 50 is allocated one or more storage spaces 2 depending on the condition-requirements of the goods ordered for delivery to a collection point, e.g. chilled, frozen and/or controlled ambient. A guidance means can contemporaneously or concurrently guide two or more users to at least part of their respective subset of lockable storage spaces 2.

The access control system 100 may comprise the guidance means. In one example of the guidance means according to the present invention as shown in FIG. 1, a first user 50*a* is allocated storage spaces 2*a* and 2*b* and a second user 50*b* is allocated storage spaces 2*c* and 2*d*. The guidance means of the present invention can guide the first user 50*a* to storage space 2*a* in a variety of ways, examples of which are detailed below. Once the user 50*a* has collected their ordered goods from the storage space 2*a*, the guidance means will then direct the user 50*a* to their second allocated storage space 2*b*. Alternatively, the guidance means may provide the user 50*a* with an indication of a location sequence of the subset of lockable storage spaces 2*a* and 2*b* at the same time, i.e. upon user registration at the locker bank 10. For at least some of the time during which the first user 50*a* is being guided for collection of their ordered goods from their allocated storage spaces 2*a*, 2*b*, the disclosed storage space access control arrangements permit the second user 50*b* (and possibly still further users, not shown) to be guided for collection of their goods from their allocated storage spaces (2*c*, 2*d* in the case of second user 50*b*) too.

Figure 10:
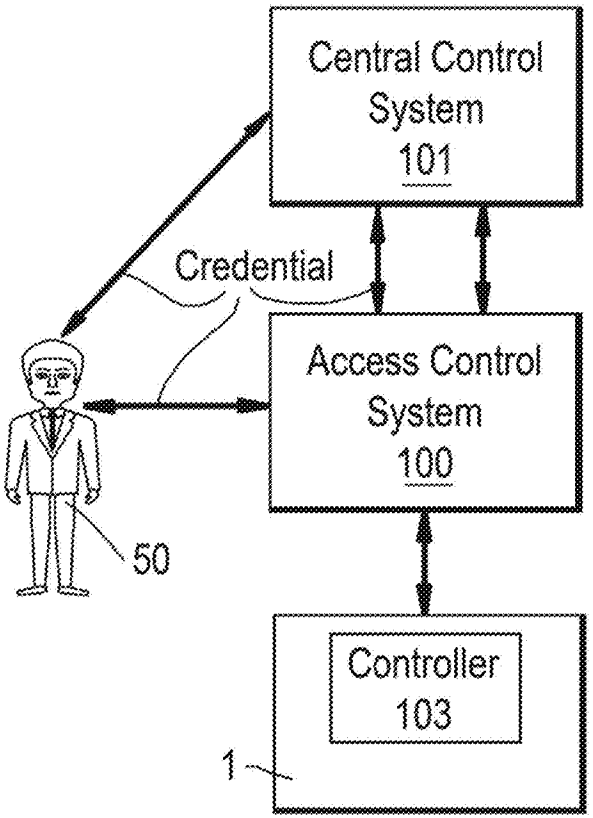
FIG. 10: A block diagram showing the communication between the central control system, access control system, and the storage installation.

Referring to FIG. 10, a central control system 101, comprised by the distribution network, may allocate the lockable storage spaces 2 for goods which have been ordered online by a user 50. Based on the status information of the lockable storage spaces 2, the central control system 101 is able to allocate at least one vacant or available storage space 2 for goods deliveries or consignments. The central control system 101 may be coupled to an access control system 100.

In order to allow a user 50 to collect goods from/to at least one of the plurality of lockable storage spaces 2, the distribution network, e.g. the access control system 100, comprises the guidance means for guiding the user 50 to the allocated storage space 2 once the user 50 has been granted access to their respective subset of allocated storage spaces 2 by the access control system 100. The access control system 100 comprises an access control processor. The access control processor can be any processing device known in the art. Typically examples include but are not limited to a microprocessor. The processor can be communicatively coupled to computer readable media such as a memory device. The guidance means is operable by the access control processor. An order can be placed by a user 50 such that the goods ordered will be delivered to at least one of the lockable storage spaces 2, i.e. a subset of the plurality of lockable storage spaces 2, located at a collection site. Once a user 50 has successfully placed an order, the allocation of the subset of a plurality of lockable storage spaces 2 allocated to said user 50 will be stored in a database along with, but not limited to, the user's identity and a list of the ordered goods. The database may be stored on a data storage device wherein the data storage device may be located in the central control system. The data storage device may comprise cloud storage 240 or be located in a supermarket or at a delivery centre, or locally within the storage installation 1. The database is coupled to the access control system 100 by way of the central control system.

The initial hurdle that the user 50 must overcome prior to being guided to their respective subset of lockable storage spaces 2 is to firstly be granted access to their respective subset, i.e. user registration. However, in order to collect the ordered goods from the subset of a plurality of lockable storage space(s) 2, the user 50 must confirm that they are in fact the same user 50 that made the order, or have been authorised by said user 50 to collect the goods. The access control system grants access to a subset of the lockable storage space 2 allocated to a user 50 provided that it identifies a user based on a credential, and this user identity via the credential matches the user identity stored in the database. The credential may include any one of, but is not limited to, a machine-readable medium such as a barcode or a passcode, a contact payment card, a contactless payment card, a contact smart card, a contactless smart card, an identity document such as a passport or a driver's license, a biometric input or a personal communications device such as a smartphone or a tablet. The biometric input may include, but is not limited to, at least one of a fingerprint, face recognition, hand geometry, iris recognition, retina, palm veins, DNA, palm print, and odour/scent. Geolocation can be used to determine that a credential is in a given place (e.g. in the vicinity of a bank of storage spaces) and can therefore be used to verify a credential, such that, upon user arrival at the collection site, the access control system 100 grants access to the subset of lockable storage spaces 2 and/or engages at least one of the guidance means. Other additional or alternative methods for credential verification are described below. In the case of sensitive data, such as biometric data, e.g. a fingerprint or face, the biometric data is stored in the enclave of the CPU of a user's device used to connect to the access control system 100. The biometric data may be only stored locally to a user's device and not stored anywhere else in the distribution network. Therefore, the access control system 100 may rely on the user's device to authenticate the biometric data during user registration. The user's device may be a personal computer or a personal communication device. In some cases, when a user registers for biometric authentication, a RSA encrypted Public/Private key which is stored and encrypted on a hardware chip in a user's device is generated. The only way that the RSA Public/Private key can be accessed by the access control system 100 is when the operating system of the user's device authenticates the user through its biometric scanner (e.g. fingerprint scanner). The private key remains on the user's device trust zone which is not accessible by software, and a server of the distribution network has the public key. When signing in, a "signature" is created by the trust zone using the private key. The signature is sent to the server where it verifies its authenticity by comparing to the public key. This allows the user 50 to register.

The access control to at least one part of a subset of the lockable storage space 2 allocated to a user 50 grants access provided that it identifies a user based on a credential. This is also referred to as user registration.

The credential may be presented by the user 50 to the access control system 100. In some cases, where the access control system 100 is located in the storage installation 1, the access control system 100 may comprise at least one access control console 102. The at least one console 102 may comprise a user interaction means and/or means to read/input the credential, e.g. a fingerprint reader, retina recognition or low power wireless communication protocols, e.g. Bluetooth®, Zigbee® etc. The user interaction means may comprise at least one of a display screen and/or a loudspeaker and/or input device and/or graphical user interface and/or a microphone. In the case that the console comprises a display screen, the display screen may be arranged in a portrait or a landscape orientation. The user 50 may register by presenting their credential at the at least one console 102. The access control system 100 compares the credential data with the information stored in the database; if there is a match, access to a subset of the plurality of lockable storage spaces 2 will be granted to the user 50, otherwise access will be denied. The advantage of this is that by having more than one console 102 per locker bank 10, two or more users can contemporaneously register to be granted access to their respective subsets of lockable storage spaces 2, and in turn, two or more users can contemporaneously be guided to their respective subsets of lockable storage spaces 2.

Figure 3:
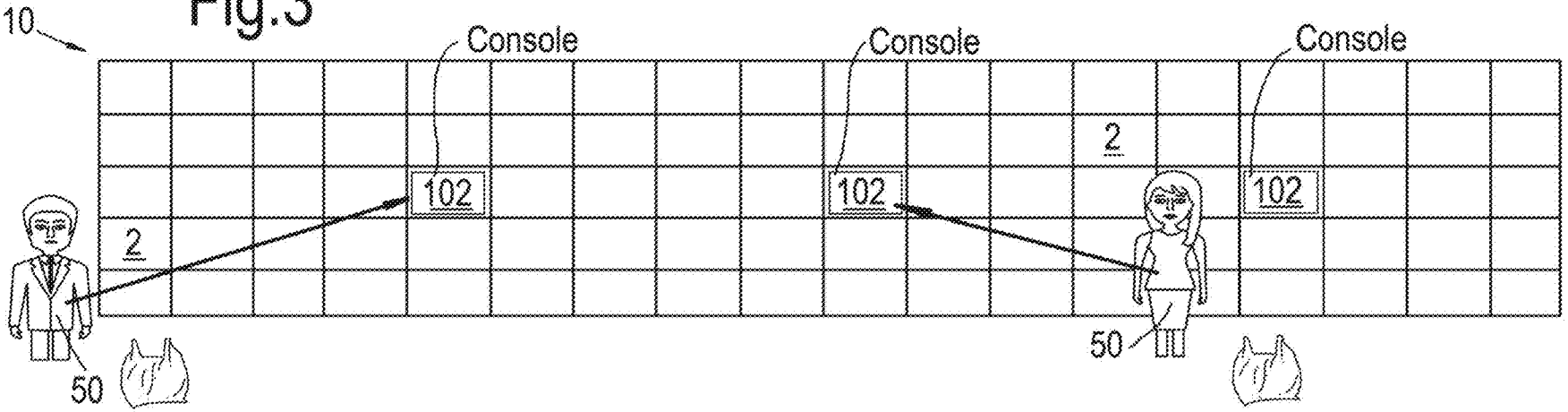
FIG. 3: A schematic view of a locker bank comprising a plurality of consoles.

Typically, the access control console will communicate to the user 50 the location of the first lockable storage space (or only a lockable storage space 2 if only one storage space is allocated) and the user 50 will retrieve their goods from this allocated storage space. The access control system 100 is coupled to a controller 103 located in the storage installation 1 which can control the lock status of each storage space 2. Once the user 50 is granted access to their respective subset, the first storage space 2 allocated to said user is unlocked or opened and the user 50 retrieves their goods from the first storage space. Acknowledgement that the goods have been retrieved from the first storage space storage space 2 can be determined by the user closing the door or the storage space senses that goods have been removed from the storage space, e.g. senses a change in weight (load cell), interruption in light, motion sensor etc. Upon closing the first storage space 2, the controller 103 may lock the first storage space 2, and the user 50 returns to the console 102. The console 102 will communicate to the user 50 the location of the subsequent storage space 2 in their subset. Therefore, two or more users (maximum number of users determined, in this case, by the number of available consoles 102 at the storage installation 1 or by the number of available consoles 102 in each locker bank 10) may be contemporaneously guided to their respective subsets of lockable storage spaces 2. Each locker bank 10 in the storage installation 1 may comprise at least one console 102. FIG. 3 shows an example of three consoles 102 in a locker bank, and how each user 50 may go to separate consoles in order to be guided to their respective subsets of lockable storage spaces 2.

The access control system 100 may communicate to at least one personal communications device 230 of a user 50. Examples of a personal communications device are a cellular phone, tablet, smart phone, smart watch, laptop etc. The communication between the access control system 100 to the user's personal communications device 230 may be wireless means such as email, Bluetooth®, Zigbee, induction wireless, ultra Wideband (UWB), infrared wireless, near-field communication (NFC) and/or radio-frequency identification (RFID) etc. The user 50 may present a credential via their personal communications device, and if it matches the identity of a user 50 stored in the database that was allocated a subset of a plurality of lockable storage spaces 2, may be granted access to their respective subset of lockable storage spaces 2. Therefore, a user 50 can be granted access to their respective subset of a plurality of lockable storage spaces 2. A personal communications device 230 may also communicate with another personal communications device and/or wearable communications device, for example a user's smart phone may communicate the locker sequence or subsequent storage space from which item(s) are to be collected to the user's smart watch or smart glasses or headphones/earphones via Bluetooth or other wireless or wired connection means). By having a personal communications device communicate with another personal communications device and/or wearable communications device allows a user to not have to simultaneously hold their personal communications device whilst simultaneously opening/closing their allocated storage spaces 2 and/or collecting their item(s), so as to allow both hands to remain free for the process of collecting goods.

The present invention may be used by more than one courier. For example, a user 50 may be allocated a subset of lockable storage spaces to which at least one retailer may deliver. This is useful in the scenario whereby a storage installation or locker bank is located in an apartment building as the couriers of each retailer can then deliver the items to at least one storage space allocated to a user 50.

The distribution network comprises a server. The server may be located in or proximate to the storage installation 1, or may be remote from the storage installation 1. An application may be stored in the server, and this application may communicate with a mobile app on the user's personal communications device. A user may set up an account with a retailer and provide details of preferred collection sites which could be close to home or work as well as providing personal details such as name, address, payment details, e.g. bank or Paypal®. The personal details of the user are stored in a database which could be located in the server of the distribution network and is managed by the central control system 101. The central control system 101 also links to a delivery system which manages delivery of goods to a user's preferred collection sites according to their preferences in their account. A user having an account with the central control system 101 can log onto a website associated with the central control system. The website has a link to at least one retailer and/or delivery system associated with the central control system. Access to the website can be through the user's personal communications device, e.g. via a mobile app.

The present invention may use any distribution network means known in the art for coordinating the management of data between an access control system and a server (or central control system) in respect to a delivery and collection system comprising a plurality of automated locker assemblies, e.g. WO2017163018A2 to Bybox Holdings Limited.

The application in the server may communicate with the access control system 100 such that the user 50 can register for access to their respective subset of a plurality of lockable storage spaces, and also be guided by their mobile app on their personal communications device. Therefore, much like as described above, once a user 50 has registered and been granted access by the access control system 100, at least part of the location sequence will be communicated to the user 50 via the mobile app on the personal communications device. Alternatively, the application in the server delivers at least part of the location sequence to the user's personal communication device by email or SMS, or other means, other than via the mobile app. Alternatively, the personal communications device is only used for user registration, and the user 50 is guided to their respective subset of a plurality of lockable storage spaces 2 by at least one of the other guidance means disclosed in this disclosure such as the at least one consoles, the at least one printer, a customer information display system, the scanner stations and/or any others. Alternatively, the user registration is completed via the at least one console, and the user 50 is guided to their respective subset of lockable storage spaces 2 by their personal communications device. In this case, once a user has registered at the console, the console or access control system 100 may communicate to the user's personal communications device the location of the storage space 2, and once the user has retrieved their goods from said storage space 2 (i.e. closed the storage space 2), the console or access control system will again communicate to the user's personal communications device indicating the location of the subsequent storage space. In some cases, the entire location sequence may be communicated to the user by way of the personal communications device. The communication may be via at least one Bluetooth emitter which is located proximate to the storage installation. Alternatively, the communication may be via any wireless means between either the storage installation 1 and the personal communications device, or between the server and the personal communications device.

The personal communications device 230, having received the location sequence from the access control system 100, may guide the user 50 by any sensory channel of said user 50, or combination of sensory channels of said user 50. For example, the personal communications device may display a visual/graphical guide showing the storage spaces location within the storage installation 1, or display a textual guide which says "4C", or display an augmented reality view (discussed in more detail below). Optionally, or additionally, the personal communications device may playback an auditory guide, for example, different tones depending on the distance the user is from the allocated storage space 2 (i.e. proximity/directional guidance) or synthesised speech whereby the loudspeaker of the device will provide directional and/or instructional guidance (i.e. "left, then forward, then right" and/or "Your next locker is 4C"). Further optionally, the personal communications device 230 may provide haptics feedback for proximity/directional guidance, for example, the device will vibrate when within a pre-determined distance from the allocated storage space 2; and/or guide the user towards the allocated storage space by varying the haptic output depending on proximity to it. The predetermined distance may be determined by the retailer or manufacturer of the plurality of storage spaces 2. Not all of these guidance means by sensory channels need be implemented on a personal communications device; they may optionally be centrally or selectively distributedly displayed or broadcast by suitable display screens and/or loudspeakers and/or any other guidance means disclosed herein and located in or proximate to the storage installation 1.

The personal communications device may also be provided with an augmented reality view of at least a part of the storage installation 1, preferably the user's respective subset of a plurality of lockable storage spaces, on the display screen of the personal communications device. The augmented reality view may be provided to the personal communications device from the access control system 100. This may allow the user 50 to (virtually) view the contents of the lockable storage spaces 2 allocated to said user 50 if they are pointing a camera of the personal communications device in the direction of the plurality of lockable storage spaces 2. The view of the storage space 2 contents viewed by the user 50 via the personal communications device may comprise at least one image from inside the storage space 2 or a live view of the storage space 2. Therefore, at least one digital camera or the like may be placed within the storage space 2, optionally coupled with at least one data storage device. Alternatively, the at least one image may be formed by an application, coupled to the access control system, which uses information from the distribution system 1 database (based on the order placed in the database) such as the ordered goods and location of the lockable storage space(s) 2, to form a virtual image of the contents or provide a set of graphical symbols or text representing the contents of the allocated lockable storage space or spaces, as part of the AR image viewed on the personal communications device. For example, the live view of the goods, graphical or text representations may be superimposed on the corresponding allocated storage spaces in the AR image. As indicated above, the remainder of the AR image may be provided by a camera provided as part of the personal communications device. In addition or in a more basic form, the AR image may highlight the allocated subset of storage spaces, e.g. in a different colour to the remainder of the AR image, or in any other suitable way (e.g. by a sequence of numbers from 1 to n superimposed on the relevant storage spaces, indicating a user's preferred or optimum order of collection from n allocated storage spaces).

The access control system 100 may comprise wireless emitters to broadcast guidance instructions to a user's personal communications device 230. The wireless emitter may comprise any common wireless means known in the art such as Bluetooth, Zigbee or wi-fi emitters. The user may pair their personal communications device with the access control system during user registration so as to allow the broadcasts to be announced by their personal communications device. This broadcast signal can provide guidance instructions to the user 50 by any sensory channel, as discussed above (e.g. visual/graphical, auditory and/or haptic).

The access control system 100 may comprise a virtual assistant, such as a chatbot system, to indicate the location sequence of the at least one storage space 2 allocated to a user 50. A chatbot system may comprise a downloadable personal communications device application to allow a user 50 to conduct a conversation via auditory or textual means with a chatbot. The chatbot can indicate to the user 50 the location of the lockable storage spaces 2 allocated to said user 50. The chatbot system may be used for granting access to the lockable storage spaces 2 allocated to said user 50 by being in communication with the access control system 100.

Figure 4:
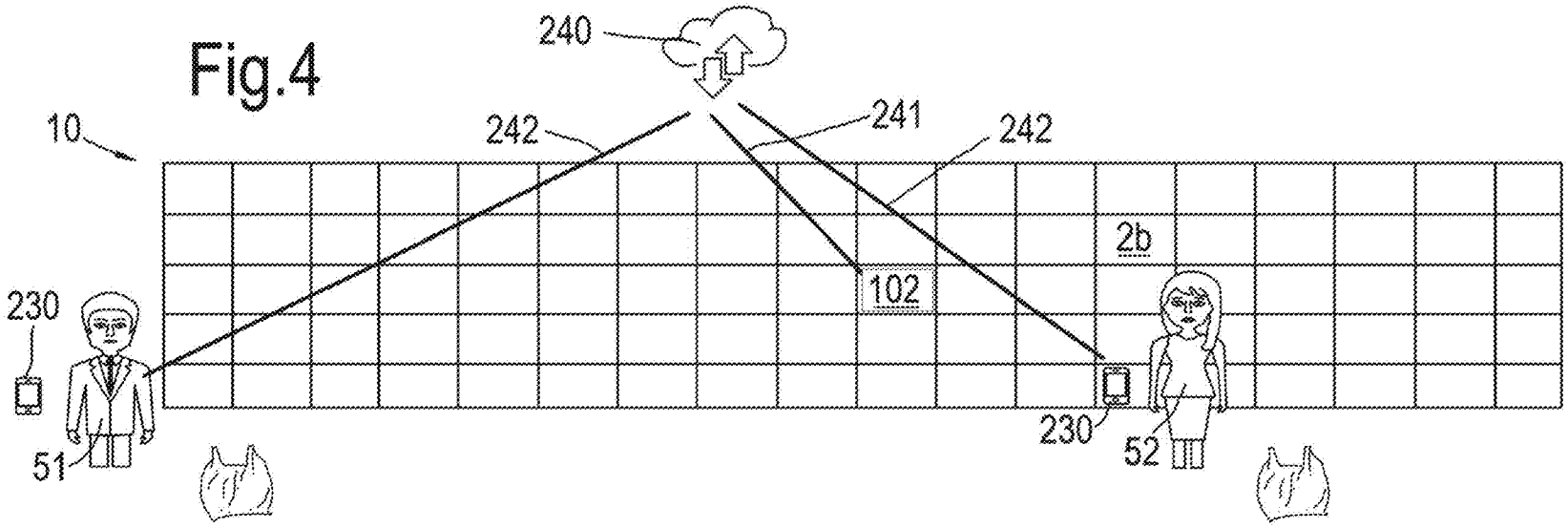
FIG. 4: A schematic view of a locker bank comprising personal communications devices as guidance means.

Referring to FIG. 4, when a first user 51 registers with the access control system 100, a processor within the locker bank 10 or at the storage installation 1, or even remote from storage installation 1, communicates with the first user's personal communications device 230, which may comprise an application. Alternatively or additionally, the locker bank 10 and/or its storage spaces 2, 2*a*, 2*b* may comprise communication means 241 in communication with an access control program e.g. running in the cloud 240. The access control program may be processed by the processor in the server of the distribution network or by a separate processor that is remote of the server. The cloud 240 may form part of the central control system. The consumer's personal communications device application and the access control program are "linked" by the customer order number or equivalent identifier (which is assigned to the customer when placing the order, and stored in a database wherein the database is located in the distribution network, e.g. in the central control system 101, e.g. stored in the cloud 240) such that the personal communications device 230 and the cloud 240 are in communication via communication means 242. The access control program may communicate to the user 50, by way of the user's personal communication device 230, at least part of the location sequence of said user's respective subset of lockable storage spaces 2 from the cloud 240 via communication means 242. When the user 51 closes the storage space 2*a* after having collected their ordered goods from the lockable storage space allocated to them, the processor in the locker bank and/or the access control program communicate (via communication means 241) with the user's personal communications device 230 such that the location of the next storage space is communicated to the user 51 and/or the subsequent storage space in the user 51's allocated subset is unlocked and ready for the ordered goods to be collected by the user 51. A second user 52 with an allocated subset of lockable storage spaces which includes storage space 2*b* may be guided to such a subset by the same means described above for the first user 51, i.e. the first user 51 and second user 52 are contemporaneously (at least partly simultaneously) guided to their respective subsets of lockable storage spaces 2*a*, 2*b*. This is discussed in more detail below. Communication means 241 and 242 may be any of email, wi-fi, SMS etc.

As disclosed above, there are two user registration means via the access control system 100; these are through (i) the at least one console 102 or (ii) the personal communications device of the user 50. The guidance means may include at least one of the at least one console, at least one scanner station, a customer information display system, at least one printer, the personal communications device and any of the other guidance means disclosed herein.

Any guidance means disclosed herein may be used in combination with any other guidance means also disclosed herein. It will become apparent how this is possible, and why it may be advantageous, through this disclosure.

Upon placing the order or during setting-up of an account with the central control system or during user registration with the access control system, the user can select a preferred type of guidance means. This may be advantageous where the user has a physical disability. For example, a visually impaired user may select to be guided by a loudspeaker system and/or haptic feedback and/or a refreshable braille display input device guidance means. As another example, an auditorily impaired user may select guidance means comprising a haptic or visual modality, such as a path projection system, a visual display on a personal communications device, a head-mounted display and/or a head-up display. The central control system may reserve the allocation of wheelchair accessible storage spaces for users who select to have a wheelchair accessible storage space. These wheelchair accessible storage spaces may only be allocated to non-wheelchair users in the scenario that all non-wheelchair accessible storage spaces at the collection site 1 or the locker bank 10 or the plurality of lockable storage spaces 2 have already been allocated. The access control system 100 first requires that the user registers to be granted access to their respective allocated storage spaces, and once this is completed by the means discussed above (via the console or the personal communications device), the user 50, 51, 52 can then rely on at least one guidance means of the access control system 100 to guide them to their respective subsets of lockable storage spaces 2. Alternatively, the user 50, 51, 52 may be guided to their respective subsets of a plurality of lockable storage spaces 2 by the same means by which they registered, for example, if the user 50, 51, 52 registered and was granted access to their respective subset by a console 102, they may be guided to their respective subset of lockable storage spaces 2 by that or another (e.g. conveniently, but not necessarily, the nearest) console 102.

When employing any of the guidance means, the access control system 100 may facilitate the unlocking/opening of subsequent allocated storage spaces 2 when the preceding allocated storage space 2 has had its contents retrieved by the user 50 and the preceding storage space 2 has been closed. The access control system 100 may unlock a subsequent storage space when its location is communicated to the user 50, and lock said storage space 2 when it is closed. Alternatively, the user may be need to manually open/unlock the storage space that they have been guided to. This may involve a user 50 inputting a code to an input device and/or presenting a credential to a scanner/reader to open/unlock the storage space 2 allocated to said user 50. The input device may be a keyboard or a keypad to enter an alpha(/) numeric code. The scanner/reader may be any scanner or reader to detect any of the credentials listed above, i.e. for a biometric credential such as a portrait photograph, the scanner will be an optical device for face recognition. The input device and/or scanner may be located proximate to each storage space. Alternatively, the input device and/or scanner/reader may be located such that there is one input device and/or scanner/reader per column of the locker back 10. As a further alternative, at least one input device and/or at least one scanner/reader may be located in each locker bank 10. Yet alternatively, geolocation functionality of a user's personal communications device (which device has also served as a credential to verify their identity) may be used to establish the user's proximity to the next storage space in their allocated sequence, and cause the access control system to unlock that storage space.

Access by the access control system 100 to each lockable storage space 2, or a subset of lockable storage spaces 2 allocated to a user 50, is governed by electronically locking/closing and unlocking/opening the storage space 2, upon verification of user identity based on a credential of said user 50. The electronic locking mechanism can be any mechanism known to the person skilled in the art such as an electromagnetic lock ("maglock"), an electronic strike or electronic deadbolts and latches. The access control system 100 may also monitor the status of each storage space 2 and transfers the status information to a server. Status information may include, but is not limited to, at least one of temperature information, dehumidifier information, vacuum information, the light source information, occupancy information, compartment size information, window information, fire sprinkler system information, lock information, and alarm condition information.

The access control system 100 may be coupled to a controller 103 located in the storage installation 1 which can control the lock status of each storage space 2, as shown in FIG. 10.

Figure 5:
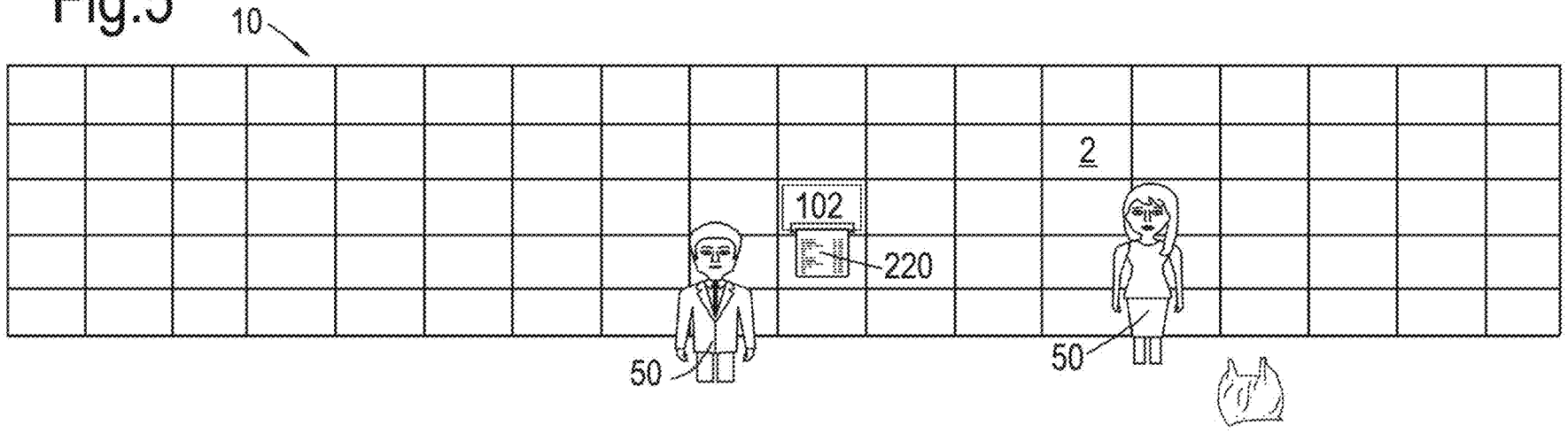
FIG. 5: A schematic view of a locker bank comprising a printer.

Referring to FIG. 5, the access control system 100 may comprise at least one printer 220 as a form of guidance means. The at least one printer may operate in conjunction with the at least one console 102. Upon registration by way of the access control system 100, the printer may print a note indicating the location sequence of the subset of lockable storage spaces allocated to a user 50. The note may also include a machine-readable medium and/or alphanumeric code which may be also act as a credential for access to a respective subset of the lockable storage spaces 2. The at least one printer may be positioned in a locker bank 10, preferably proximate to each console 102. A printer can be positioned anywhere in the storage installation 1. As each user 50 at the storage installation has their location sequence revealed by the printed note, each said user 50 does not need to return to a console 102 subsequent to retrieving their goods from each allocated storage space 2. Therefore even a single console 102 in conjunction with a printer can permit a plurality of users 50 to contemporaneously access their respective subsets of lockable storage spaces 2.

Optionally, the access control system 100 may not comprise a printer but a pre-printed note/receipt is provided together with the goods contained by the first allocated lockable storage space of a user's respective subset. The note may comprise a credential for opening any further allocated storage spaces 2 associated with that order. The credential may be integrated in the note, or may be separate to the note. The credential can be any suitable one or more of the credentials in this disclosure, or a single use RFID tag.

Figure 6:
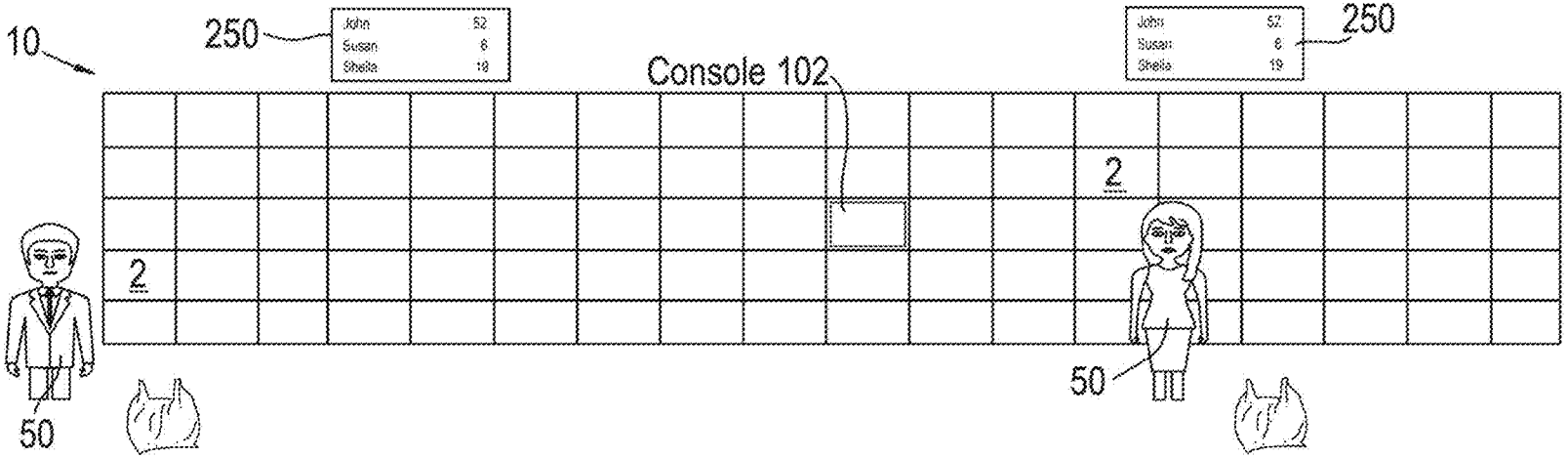
FIG. 6: A schematic view of a locker bank comprising a customer information display system.

Referring to FIG. 6, the access control system 100 may comprise a customer information display system as a form of guidance means. The customer information display system may comprise at least one customer information display panel 250. Upon registration, by way of the access control system 100, the customer information display system will indicate the location sequence or subsequent storage space 2 of a respective subset of lockable storage spaces 2 to a user 50 via at least one customer information display panel. The storage space location(s) may be indicated on the display each in association with a unique display name, code word, order number, or other identifier (e.g. submitted or generated when placing the order, or associated with a user's account, or submitted or generated on registration to collect the order) by which the user can identify themself and their allocated storage space sequence. The customer information display panel is in communication with the access control system such that a first storage space 2 of the location sequence from which goods are to be retrieved is unlocked, and when it is closed/locked following retrieval, a subsequent storage space 2 of the locations sequence displayed on the customer information display panel is unlocked, and so on. The at least one customer information display panel displays at least a part of the location sequence of each registered user 50 that is yet to collect their delivered goods. Therefore, the customer information display system allows for two or more users 50 to contemporaneously be guided to their respective subsets of a plurality of lockable storage spaces 2 allocated to said user 50. There may be at least one customer information display panel 250 located on or proximate to the at least one locker bank 10 of the storage installation 1.

Figure 7:
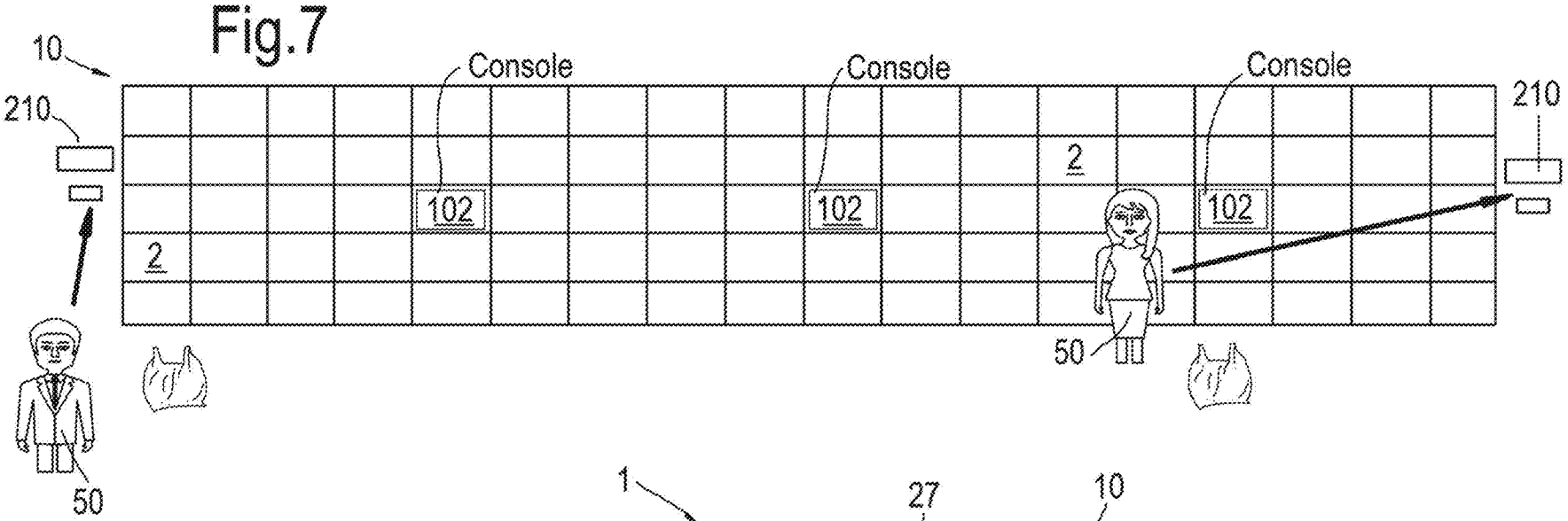
FIG. 7: A schematic view of a locker bank comprising two scanner stations.

Referring to FIG. 7, the access control system 100 may comprise at least one scanner station 210 as a form of guidance means, whereby, following user registration and retrieving their goods from their first allocated storage space 2, the user 50 then goes to such a scanner station which will communicate to the user 50 the subsequent storage space of their respective subset when the user 50 presents a credential at the scanner station. Alternatively, the user 50 may go directly to such a scanner station upon having successfully registered with the access control system 100, then the scanner station will communicate to the user 50 the subsequent storage space of their subset after the user 50 presents a valid credential or inputs a valid alpha(/)numeric code to the at least one scanner station. The scanner station comprises a scanner and/or an input device to read and/or allow the user to input a credential. The scanner may be at least one of a barcode reader, a laser scanner, an image scanner, an infrared scanner, an NFC scanner, a Bluetooth receiver or an RFID scanner. The input device may be a keyboard or a keypad to enter an alpha(/)numeric code. The controller 103 may unlock the subsequent storage space when its identity is communicated to the user 50, and may lock this storage space 2 when it is closed again by the user. The at least one scanner station serves the same function as a console 102 except for user registration; therefore, it is used for guiding a user 50 to their respective subset of lockable storage spaces. The at least one scanner may be provided adjacent to at least one side of the locker bank 10. For example, there may be two scanner stations, one at either side of a locker bank 10. Other numbers and arrangements of scanner stations are possible. For example, a scanner station may be provided within arm's reach, or within easy reach, or near to, every storage location; or even at every storage location. The scanner station may comprise a display or other guidance system. Therefore, the scanner station permits two or more users 50 to contemporaneously be guided to their respective subsets of allocated lockable storage spaces 2.

The scanner station may comprise a virtual assistant with a loudspeaker and microphone such that the user 50 can "communicate" with the virtual assistant. The virtual assistant may guide the user 50 to their subsequent storage space via speech commands. Preferably the virtual assistant can guide the user 50 to their next storage space via speech commands when prompted by the user 50. The virtual assistant may be a chatbot which can communicate with a user's personal communication device to provide textual, auditory and/or visual output from the personal communication device, e.g. a map of the storage installation, with the next storage location or a partial or complete sequence of the allocated storage locations shown on it; identifying numbers, letters or the like for the next storage space or spaces in the sequence of allocated storage spaces, presented on a visual display or via speech synthesis, etc.

Other guidance means may include a storage space number display system in which each storage space 2, comprises a storage space number display screen. This display screen may be positioned proximate to the storage space, preferably directly above, on the side or below the storage space 2 or on the storage space access door, such that the storage space number display screens may indicate the number of the next storage space 2 in the allocated sequence, wherein the storage space number is a pre-assigned label (determined by the manufacturer or online retailer) for each storage space 2. This label may comprise letters and other symbols, besides numbers. The storage space number display screen indicates to the user 50 the next storage space 2 in their sequence of allocated storage spaces 2, or more than one of the subsequent storage spaces 2 in their sequence of allocated storage spaces. In the event that the user 50 does not have any subsequent compartments 12 and/or storage spaces 2 allocated to them (i.e. the collection or delivery of the ordered goods is complete), the storage space number display screen may indicate this.

Another guidance means may include a light-based display. The display may comprise a light/pattern-based display. A light-based display may comprise any suitable light sources, such as anincandescent or fluorescent light bulbs or light-emitting diodes. The light sources may be placed on the door 11 of each storage space 2 or proximate to each storage space 2 such that there is at least one light source corresponding to each storage space 2. There may be several light sources associated with each storage location; each light source being of a different colour, so as to provide the same set of different colours at each storage location. Alternatively a single light source capable of providing light of variable colour may be associated with each storage location. Upon being granted access to the lockable storage spaces 2 by the access control system, the user 50 may be assigned a colour or a combination of colours, but preferably a single colour. This colour or colour combination can be used to indicate the location of the first, subsequent and/or all of the storage spaces 2 allocated to the user 50. If a first user 51 is assigned a first colour or colour combination, a second user 52 is assigned a second colour or colour combination different to the first. The light source of the light-based display may be an LED or other display which could have the user's name displayed in a particular colour. For colour-blind users, a flashing or intermittent light may be used such that each user 50 is assigned a different flashing pattern. The display or an array of light sources associated with each storage space may indicate those allocated to a particular user by showing a particular distinctive pattern, symbol or avatar (e.g. diamonds, hearts, clubs, spades, chequerboard, zodiac signs, animals, numbers, letters, etc.) This may or may not use different colours. The user may choose their storage space identifying symbol on placing their goods order, or as a part of setting up a user account with the retailer or distribution service provider; or the storage space identifying symbol (like the light colour or colour combination) may be assigned and notified to the user upon registration at the storage installation 1 immediately prior to collection of their goods.

The light source may be provided within the storage space 2 and the colour may be seen through a window in the door 11 of the storage space. The light source may be an intermittent or constant light source. The colour of the light may be determined by electrochromic glass of the door 11, or it may be determined by the colour of the light source itself through an ordinary transparent/translucent window. The electrochromic glass of the door 11 may also use a level of dim to indicate the location sequence to the user 50, e.g. all windows made of electrochromic glass at a particular level of dim indicate that the associated storage spaces 2 are allocated to a user 50, for example, only the windows which are not dimmed belong to a subset allocated to a user 50.

Another guidance means may be a head-mounted system to indicate the location sequence of the at least one storage space 2 allocated to a user 50. The head-mounted system may comprise at least one optical head-mounted display and/or other head-mounted device. The optical head-mounted display (also known as "smart glasses") is a wearable device allowing a user 50 to see through the device as well as having the capability of projecting images onto the lens of the glasses for reflection into the eye(s) of the user 50. The head-mounted system may be a virtual reality headset. The head-mounted system communicates with access control system 100 either via a connection with the user's personal communication device (by Bluetooth or other means well known in the art) or it communicates directly with the access control system 100 in the same way as a personal communications device. This allows the user 50, wearing one of the optical head-mounted display device to view the contents of the lockable storage spaces 2 allocated to said user if they are looking in the direction of the plurality of lockable storage spaces 2. The view of the storage space 2 contents viewed by the user 50 via the head-mounted system may be from at least one image from inside the storage space 2 or a live view from inside the storage space 2. Therefore, at least one digital camera or the like may be placed within the storage space 2, optionally coupled with at least one data storage device. Alternatively, the at least one image may be formed by an application which uses information from the distribution system 1 database such as the ordered goods and location of the lockable storage space(s) 2 to create an virtual image of the storage space contents.

Preferably, the head-mounted system operates in conjunction with a personal communications device such that the application in the server and/a mobile app for the personal communications device may communicate with the head-mounted system by way of the personal communication device's communication module, e.g. a wireless network interface such as IEEE 802.11, Bluetooth, or radio interfaces for accessing cellular telephone networks (e.g., transceiver/antenna for accessing a CDMA, GSM, UMTS, or other mobile communications network). The head-mounted system may communicate with the personal communications device by Bluetooth or other suitable wireless means, or by a wired connection. In some cases, such as when the head-mounted system comprises a processor, the head-mounted system may be a personal communications device.

Another guidance means may be a path projection system. The path projection system may comprise at least one projector wherein the at least one projector is positioned proximate to the storage installation, preferably above the locker bank 10 such that said projector can project light downwards onto the ground. Once a user has registered, either at a console or via a personal communications device, the projector can project a path onto the ground or floor indicating an efficient path, based on an algorithm (discussed in more detail below), that the user 50 can take in order to reach their allocated storage space 2. After having retrieved their goods from a first one of their allocated storage spaces and having closed said storage space 2, the access control system will actuate the at least one projector to replace the current path with a new path to the subsequent storage space 2. The paths can be determined such that the prevent users from bumping into each other. Each path may be a different colour or pattern (dots, dashes, distinctive squiggles, simulated footprint trails, textures, etc.) to prevent confusion. This guidance means may be useful in conjunction with other guidance means such as the light-based system whereby the projected path will indicate the column of the locker bank 10 in which the allocated storage space 2 is located, and the light-source proximate to the allocated storage space 2 precisely indicates the location of the allocated storage space 2. Presenting a credential at one guidance means may actuate another guidance means, for example, presenting a credential at a scanner station may actuate the lights-based guidance system. This is one way in which two or more guidance means can operate in conjunction with each other.

Alternatively, or additionally, the path may be indicated to the user by at least one light source directly in the floor rather than a projector projecting light onto the floor. Alternatively, the floor proximate to the plurality of lockable storage spaces 2 may be backlit by a light source to indicate the path. The at least one light source may be an array of LEDs.

Another guidance means may be a loudspeaker system to indicate the sequence of storage spaces 2 allocated to a user 50. The speaker system may use a programmable voice (by the manufacturer or the online retailer) to indicate the location the storage space 2 or sequence of storage spaces allocated to a user 50. The loudspeaker system may comprise a virtual assistant powered by the processor of the access control system 100. The speaker system may include at least one locker bank loudspeaker located on or proximate to at least one locker bank 10, or proximate to each or every other column of storage spaces 2 of the locker bank 10, or in such numbers and spacings as may be required to provide sufficient audibility against ambient noise. The locker bank loudspeaker may emit synthesized or pre-recorded speech to indicate the location sequence of a user's allocated storage spaces 2. The emitted speech may recite at least part of the list of storage spaces allocated to a user.

The playback instruction through the loudspeaker(s) is delivered from the processor with an optional data storage device coupled with the access control system 1. The playback may be stored in the data storage device or may be artificially created by the processor of the access control system 100.

Additionally, or optionally, the at least one loudspeaker may be a locker loudspeaker located adjacent to the locker bank 10 such that each storage space 2 comprises at least one locker loudspeaker. The locker loudspeaker may provide speech indicating the location sequence. Preferably, the speech comprises at least part of a list of the storage spaces allocated to a user 50.

The locker loudspeaker may indicate the locker number of the associated storage space 2, wherein the locker number is a pre-assigned label (determined by the manufacturer or online retailer) for each storage space 2. The locker numbers or labels may additionally or alternatively comprise letters and other characters and symbols. The locker loudspeaker may indicate to the user 50 some or all of the subsequent compartments 12 and/or storage space 2 in the sequence of storage spaces 2 allocated to them. In the event that the user 50 does not have any subsequent storage spaces 2 allocated to them (i.e. the collection or deposition of the ordered goods is complete), the locker loudspeaker may indicate as such, e.g. by speech stating "collection complete"/"deposition complete".

The loudspeaker system may comprise a microphone coupled to speech recognition software, through which a user 50 may communicate to the distribution system 1. The microphone may be coupled to a connection with customer service personnel that are part of the distribution system 1. The microphone provides means for the user 50 to have the collection sequence altered at said user's discretion. The use of a loudspeaker to guide a user to their respective allocated storage spaces is advantageous for visually impaired or blind users. Several different communications modalities (visual, auditory, tactile, etc.), each independently useable for the required information input/output from/to a user may be provided at the storage location, to cater for the different abilities, disabilities and preferences of a wide range of users; as well as for compliance with disability legislation requiring reasonable adaptations, or the like.

For all guidance means disclosed herein, the access control system 100 may unlock/open the first storage space 2 allocated to a user 50 following user registration, and then unlock/open any subsequent storage spaces 2 allocated to a user 50 when the preceding storage space allocated to the user 50 has been closed/locked. This minimises the possibility of confusion to or from other users. This also minimises the possibility of theft from an unlocked storage space 2 which the user 50 is not able to monitor, and prevents the user from having to monitor all allocated storage spaces 2. However, in some cases it may be preferable to unlock, or make unlockable, two or more of the subset of storage spaces 2 allocated to a user 50 concurrently; in this case the guiding means may communicate with the controller 103 to unlock the at least two subsequent storage spaces 2 of the location sequence allocated to said user 50. This may be useful if the user 50 has assistance to collect their ordered goods. Thus, the user may be able to specify the number of separate sequences to be unlocked, within their subset of allocated storage spaces, with the guiding means operating upon each sequence independently. This number may be specified for example when placing the order, and/or when registering for collection of the order at the storage installation 1.

Alternatively a user 50 may unlock the next storage space 2 in their allocated subset by presenting a credential at that storage space, or proximate to it. In this case, each storage space 2 may comprise an input device and/or a credential reader. The input device or credential reader may be any such device or reader as disclosed in this document, or any suitable known input device or credential reader. The user may be guided to this next storage space by any of the guiding means disclosed in this document, or any suitable known guidance means. This includes the possibility of several users being independently and simultaneously guided to a next storage space during the collection of a given goods order, as described in the preceding paragraph ("close one storage space to open the next" arrangement). Requiring a user to (re-) enter their credential in the vicinity of the next storage space to which they require access, improves security, by reducing the extent to which unlocked or opened storage spaces are unattended by their legitimate user.

The sequence by which the allocated storage spaces are arranged in the collection sequence or sequences may be determined by employing at least one algorithm to solve the "shortest path problem" or the "travelling salesman problem", such as Dijkstra's algorithm, Bellman-Ford algorithm, A* search algorithm, Floyd-Warshall algorithm, Johnson's algorithm, Viterbi algorithm or a branch and bound algorithm, to find the shortest path between storage spaces 2 in order to minimise the time that the user 50 is delivering or collecting goods to or from their at least one allocated storage space 2. Additionally or alternatively, the path may be determined by a heuristics approach. Additionally or alternatively, the ordering of the sequence may be determined by the user 50 or the retailer such that certain goods are collected first, e.g. lower mass goods before higher mass or bulky goods so as to minimise the occurrence of the user 50*a* carrying heavy loads between storage spaces 2; or vice versa for delivering goods to a plurality of lockable storage spaces 2 by user 50*b*. This can prevent potential injuries, and will also make the overall collection experience better for user 50. Optionally, the sequence may be at the discretion of the retailer, or dependent on whether goods stored in particular conditions or having particular characteristics should be collected first or last. For example eggs could preferably be collected from the final allocated storage space 2 such that the contents of other storage spaces 2 allocated to the user 50 are not placed on top of the eggs causing them to potentially crack. Optionally, the user 50 may be able to choose the order in which they collect their goods, e.g. a large frozen turkey could be collected from the first allocated storage space 2 as it may damage other ordered goods if it is collected after such goods and then placed on top of them. The user 50 may decide the location sequence prior to collecting their ordered goods, or during collection (e.g. during user registration).

In some cases, the collection sequence may be based on the location of other users also collecting their goods from their respective subsets of lockable storage spaces 2. For example, a first user is granted access to their respective subset of allocated storage spaces "10" and "25". Meanwhile, a second user is granted access to their respective subset at approximately the same time, whereby said second user is allocated storage spaces "9" and "24", adjacent to spaces 10 and 25 respectively. In this case, the second user would be guided to storage space "24" while the first user is collecting their goods from storage space "10" in order to prevent overcrowding around the storage spaces "9" and "10", with the hope of enhancing customer satisfaction. Methods of avoiding such conflict according to embodiments of the invention will be later described with reference to FIG. 13.

The information displayed on the any display screen or panel in this disclosure (i.e. the locker number display screen or the customer information display panel) of the display system may include, but is not limited to, the name and/or customer ID and/or courier ID of a user 50 and the storage space 2 number of the first and/or subsequent allocated storage space 2. Optionally, the customer information display screen may include a list (i.e. location sequence) of all of the storage spaces 2 allocated to a user 50. The display system many comprise a user interface such that the user 50 may amend the location sequence at their own discretion.

Any guidance means disclosed herein may operate in cooperation with one or more other guidance means also disclosed herein, and other commonly known guidance means in the art. For example, the first storage space allocated to a user 50 may be displayed on a display screen of a personal communications device 230 of said user 50, but any subsequent storage spaces 2 may be indicated by the locker loudspeaker and/or the locker number display screens, or any other guidance means. As another example, the next allocated storage space or a partial or complete sequence of allocated storage spaces may be indicated for a given user on the locker number display screen, by the locker loudspeaker, and by the user's personal communication device simultaneously. Other permutations and combinations are readily possible.

Any of the guidance means may indicate to a user 50 the first, subsequent and/or all of the lockable storage spaces 2 allocated to said user 50, i.e. at least a part of the locations or the collection sequence of the lockable storage spaces 2 allocated to said user 50.

Any of the guidance means may comprise at least one output device such as a display screen, speaker, printer, voice output communication aid, navigation system, scanner station, personal communications device, access control console, path projection system, customer information display panel, lights-based display system, path projection system, head-mounted system, locker number display system, etc.

A benefit of the present invention is that the access control system 100, particularly in response to the guidance means, can facilitate two or more users to contemporaneously or at least partially simultaneously collect their ordered goods from their respective subsets of a plurality of lockable storage spaces 2. In one example, a first user 50*a* is being guided by the guidance means to a first subset of lockable storage spaces 2 allocated to said first user 50*a*. In the same example, a second user 50*b* is contemporaneously guided by the guidance means to a second subset of lockable storage spaces 2 allocated to said second user 50*b*. This is only made possible by the guidance means detailed above; without such means, each subsequent user 50 must wait for the preceding user 50 to complete the collection of their ordered goods from their respective subset of lockable storage spaces 2, and return to the console 102 (which also may not allow simultaneous or contemporaneous user registration by a plurality of users 50).

As mentioned, an issue that may arise in such a multi-user system is that a plurality of users, such as the first user 50*a* and second user 50*b*, may be granted access to proximal lockable storage spaces at generally the same time i.e. at least partly temporally overlapping. Granting such contemporaneous access may cause one or more of the storage spaces not to be easily accessible due to access being restricted by the other user, or may necessitate the first user 50*a* and second user 50*b* occupying space close together in order to access the lockable storage spaces. The first user 50*a* and the second user 50*b* occupying proximal space may cause discomfort to the users. Furthermore, a distance between the first user 50*a* and the second user 50*b* dropping below a threshold distance may breach proximity regulations. Proximity regulations may be enforced with an aim of controlling spread of an infectious disease by maintaining at least the threshold distance between users. Such an event in which the first user 50*a* and the second user 50*b* are granted contemporaneous access to proximal storage spaces may be referred to as an access conflict.

Figure 13:
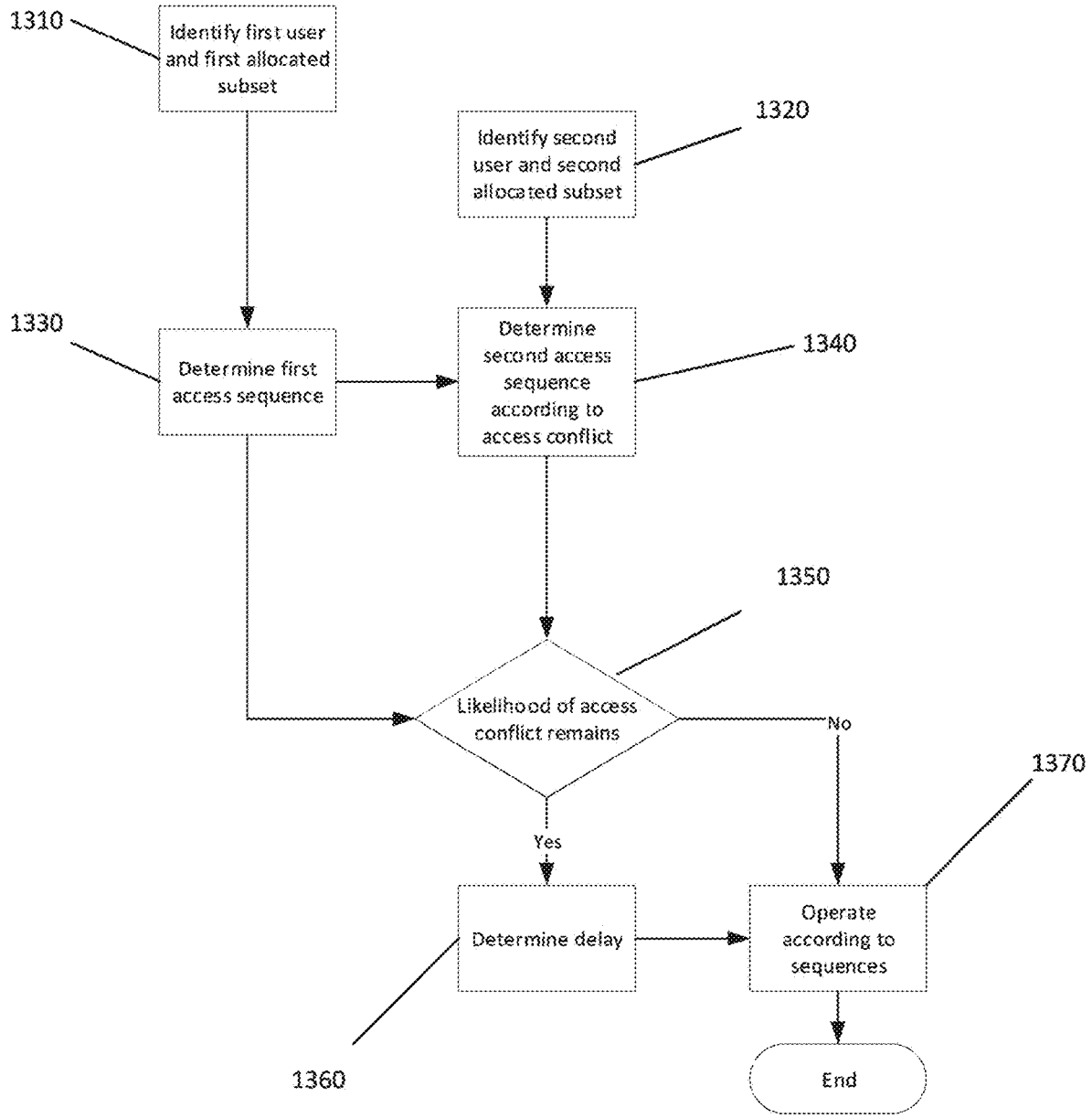
FIG. 13: A method for mitigating the risk of an access conflict between a first and second user.

FIG. 13 illustrates a method 1300 according to an embodiment of the invention for mitigating the risk of access conflicts between users by determining an appropriate access sequence for at least some or each user. The access sequence may also be elsewhere referred to as a collection sequence or location sequence, and defines the order in which the user is granted access to his/her allocated lockable storage spaces.

The method 1300 comprises a step 1310 of identifying the first user 50*a* and the first subset 2*a*, 2*b* of allocated storage spaces. The step 1310 may be performed by the access control system in a manner as has been described with respect to user registration above. The access control system may, for example, identify the first user 50*a* based on a credential in order to grant access to the first subset 2*a*, 2*b* of the lockable storage spaces 2 allocated to the first user 50*a*.

Once the first user 50*a* and the first subset 2*a*, 2*b* of the lockable storage spaces have been identified, a first access sequence may be determined in step 1330. The first access sequence defines a temporal order in which the first user 50*a* will be granted access to the first subset 2*a*, 2*b*. For example, the first access sequence may be defined as [2*b*, 2*a*] so the user is first granted access to lockable storage space 2*b* and then subsequently to lockable storage space 2*a*. The first access sequence may be determined based on a number of criteria as have been described, for example based on a shortest path algorithm, user defined criteria, to ensure certain goods are collected first, and/or the location of one or more further users.

The second user 50*b* and the second allocated subset 2*c*, 2*d* are identified in step 1320. Step 1320 may be performed generally simultaneously or subsequently to step 1310, depending on the arrival time of the second user. That is, the second user may be identified generally simultaneously to the first user, or the second user may arrive and be authenticated subsequently to the first user. Step 1320 may be performed analogously to step 1310.

A second access sequence may then be determined for the second allocated subset 2*c*, 2*d* of lockable storage spaces in step 1340 by the access control system. At least part of the second access sequence is determined in dependence on a likelihood of an access conflict with the first user. The second access sequence may be further determined in dependence on one or more of the other sequence criteria as have already been discussed.

In some embodiments, the second access sequence may not be initially determined in its entirety. In other words, a complete access sequence encompassing all of the second subset of lockable storage spaces may not be determined at the same time. The second access sequence may instead be determined successively, one portion at a time, as the second user is guided. That is, determination of the second access sequence may be determined over a period of time. For example, each portion may comprise a single lockable storage space. At least one portion is determined in dependence on the likelihood of an access conflict with the first user. For example, the choice of a next lockable storage space in the second access sequence may be determined by the likelihood of an access conflict with the first user. As part of determining the second access sequence, a delay may be inserted into the sequence in dependence on the likelihood of an access conflict at the next lockable storage space, as will be explained. It will also be appreciated that each portion may comprise more than one lockable storage space.

Steps 1340, 1350 and 1370 may therefore be performed at least partially concurrently.

An access conflict may be defined as an event wherein the first and second user are generally contemporaneously granted access to proximal lockable storage spaces, which will also be referred to as neighbouring lockable storage spaces. It is advantageous to avoid an access conflict as such an event may cause access to the allocated storage space for either user to be limited by the presence of the other user, causing inconvenience and delay. Such an access conflict may also cause a distance between the first and second user to be drop below a threshold distance, which may breach enforceable proximity regulations aimed to maintain at least the threshold distance between users. Whether two lockable storage spaces are proximal or neighbouring may be determined based on any predetermined proximity criteria, particularly defining whether the two storage spaces may be simultaneously accessed comfortably. The predetermined proximity criteria may further define whether at least a threshold distance may be maintained between the users accessing the lockable storage spaces.

Figure 14:
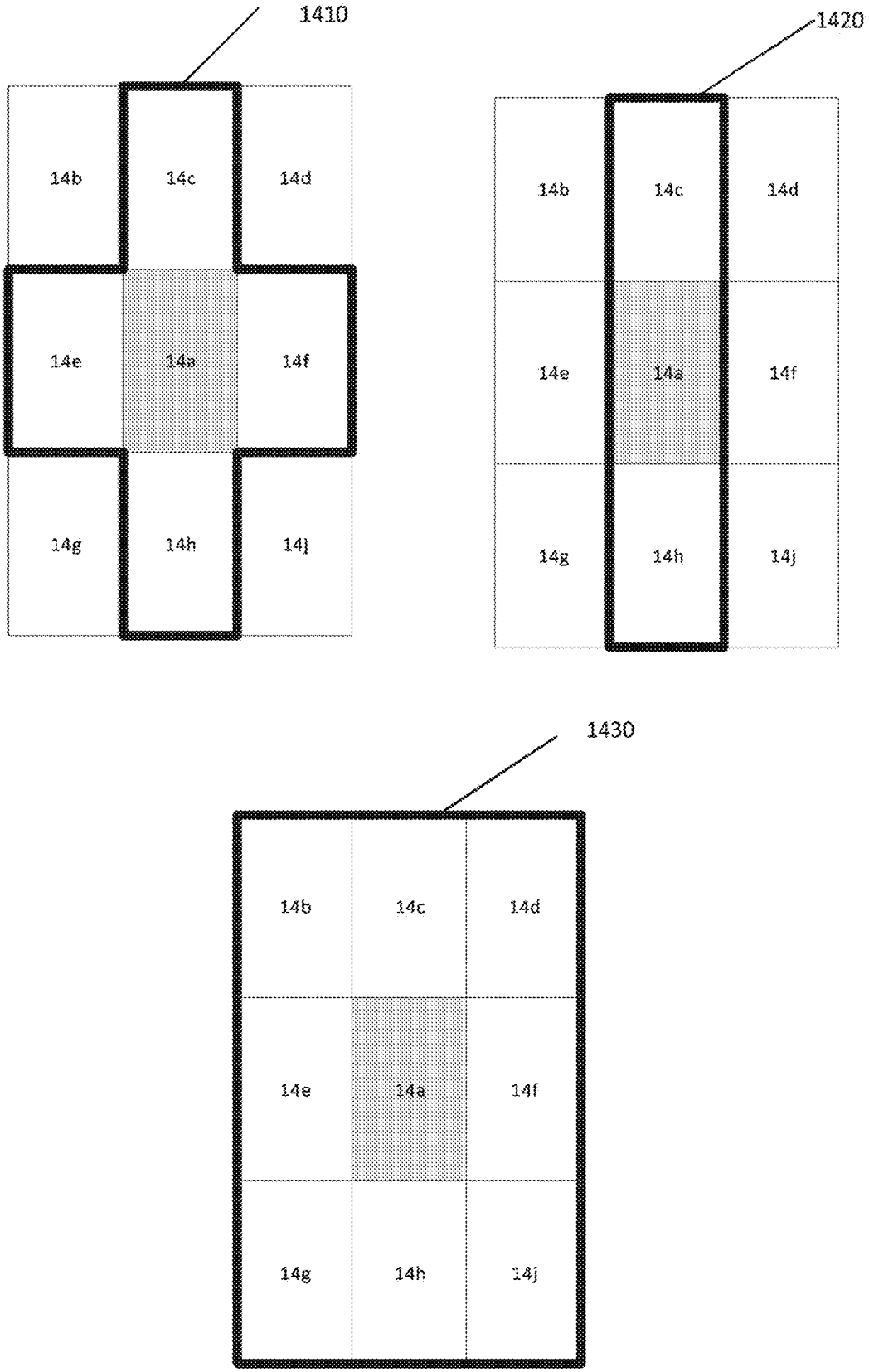
FIG. 14: A schematic view of a locker bank illustrating proximity criteria.

Three exemplary proximity criteria are illustrated in FIG. 14. The proximity criteria may comprise whether the two lockable storage spaces are within a predetermined distance. For example, the predetermined distance may be an absolute distance, or a number of lockable storage spaces. The predetermined distance may be a threshold distance required to be maintained between users to abide by proximity regulations. For example, the predetermined distance may be at least 1 m or at least 2 m. The predetermined distance may be expressed in a number of lockable storage spaces, such as at least two lockable storage spaces. The predetermined distance may in some embodiments be directional, for example a horizontal distance, a vertical distance, or a combination of the two. That is, a respective distance may be defined for each of vertical, horizontal and, in some embodiments, diagonal directions. If the lockable storage spaces are arranged in columns and/or rows, the proximity criteria may comprise whether the two lockable storage spaces share a column, whether the two lockable storage spaces share a row, or whether the two lockable storage spaces are within a predetermined number of rows or columns.

FIG. 14 illustrates an example lockable storage space 14*a*, and the boundary of neighbouring lockable storage spaces considered to meet three different proximity criteria. It will be appreciated that these examples are illustrative and any other appropriate criteria may also be used, as described.

Boundary 1410 illustrates a proximity criterion defined by horizontal and vertical neighbours to lockable storage space 14*a*. The proximity criterion illustrated by boundary 1410 may comprise whether a lockable storage space is within 1 space horizontally or vertically from lockable storage space 14*a*. This criterion is met by lockable storage spaces 14*c*, 14*e*, 14*f* and 14*h*.

Boundary 1420 illustrates a proximity criterion comprising whether the lockable storage spaces share a column with space 14*a*. In this example this criterion is met by lockable storage spaces 14*c* and 14*d*.

Boundary 1430 illustrates a proximity criterion defined by surrounding neighbours to lockable storage space 14*a*. The proximity criterion illustrated by boundary 1410 may comprise whether a lockable storage space is within for example a predetermined distance such as 50 cm, or a number of storage spaces such as 1, in any direction from lockable storage space 14*a*. The proximity criterion illustrated by boundary 1410 may further comprise whether a lockable storage space is within a predetermined number of rows and columns from the lockable storage space 14*a*. For example, the proximity criterion may comprise whether a lockable storage space shares a column with the lockable storage space 14*a*. The proximity criterion may comprise whether a lockable storage space is within a predetermined number of columns from the lockable storage space 14*a*, for example within one column in either direction. This criterion is met by all surrounding lockable storage spaces in the illustration.

Figure 15A:
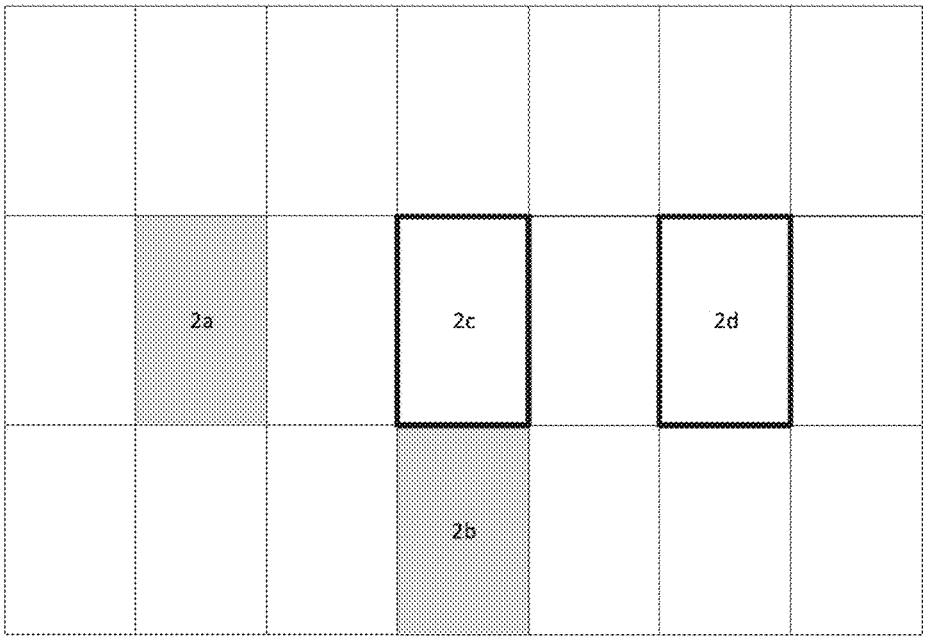
FIGS. 15A-15C: A schematic illustration of a first and a second access sequence.

The likelihood of an access conflict with the first user occurring may be determined in dependence on the first access sequence. In particular, the likelihood of an access conflict may be determined based on whether, for each allocated lockable storage space of the second subset, a neighbouring lockable storage space exists in the first access sequence. For example, FIG. 15A illustrates an example configuration of the lockable storage spaces in the first subset 2*a*, 2*b* and the second subset 2*c*, 2*d*, wherein 2*c* and 2*b* are neighbouring. There may be determined to be a likelihood of an access conflict, as neighbouring storage spaces exist between the subsets.

Figure 15B:
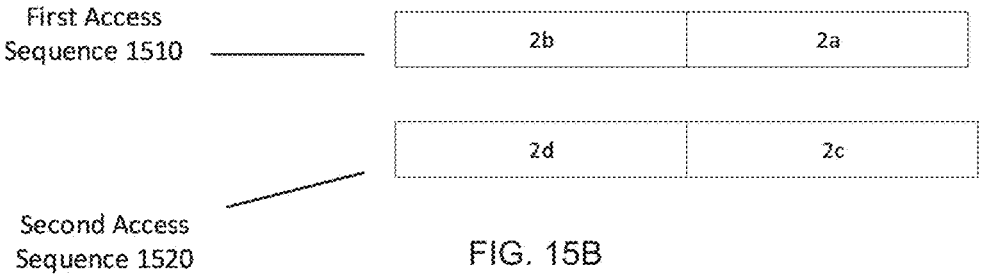

Step 1340 comprises determining the second access sequence in dependence on said likelihood. The second access sequence may be determined to reduce or minimize the likelihood of the access conflict occurring. For example, the first access sequence 1510 as illustrated in FIG. 15B may have been determined to guide the user first to space 2*b*, and then to space 2*a*. The second access sequence may then be determined to reduce the likelihood of an access conflict occurring by the first user and second user contemporaneously attempting to access neighbouring lockers 2*c* and 2*b*. In this case, the second access sequence 1520 may be determined to guide the second user 50*b* to space 2*d* first, while the first user is accessing storage space 2*b*, and then to space 2*c* while the first user is accessing space 2*a*. By arranging the second access sequence 1520 in this way, the likelihood of an access conflict may be minimized. In some embodiments, step 1340 may comprise determining at least a portion of the second access sequence by including one or more delays, as will be discussed in step 1350. The second access sequence may be determined to include delays in addition to or instead of ordering the sequence to avoid access conflicts.

Figure 15C:
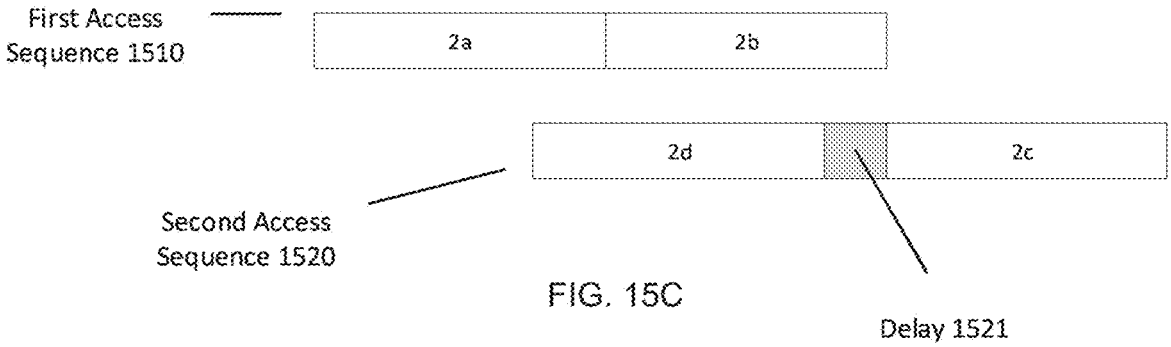

The method 1300 comprises a step 1350 of determining whether a likelihood of access conflict remains above a predetermined threshold. Step 1350 may be implemented at any point during operation of the system, including during an initial determination of the second access sequence, or while the first and second user are being guided along the first and second access sequences respectively. As discussed, the second access sequence may be determined in successive portions, and step 1350 may be performed during the determination of one or more portions. The likelihood of access conflict may be unable to be completely mitigated by appropriate ordering of the second access sequence. That is, for any access sequence of lockable storage spaces an access conflict between users may exist. In this case, it may be determined that a likelihood of access conflict remains, and further intervention may be required. An example is illustrated in FIG. 15C. Due to the arrival time of the second user, the second access sequence cannot be arranged such that no period of access conflict exists. In this case, it may be determined in step 1350 that the likelihood of access conflict remains above the predetermined threshold. Such a situation may also arise during implementation of the access sequence, for example if a user takes longer than anticipated to retrieve goods from a lockable storage space.

If the likelihood is determined to be or remains above the predetermined threshold, at least one delay period may be determined for one or both of the first access sequence and the second access sequence in step 1360. The delay period may be inserted into one or more of the access sequences, as will be explained. It will be appreciated that more than one delay period may be inserted into an access sequence i.e. two delay periods may be inserted separated by one or more locker accesses.

An example delay period 1521 is illustrated in the second access sequence 1520 in FIG. 15C. The delay period 1521 may be incorporated into either access sequence at an appropriate point to mitigate the likelihood of an access conflict. The delay period may be a predetermined length of time, e.g. 10 seconds or another appropriate time period. Alternatively, the delay period may be defined as a flexible time period subject to at least one condition being met. For example, the condition may be the other user vacating a conflicting lockable storage space. In the illustrated example in FIG. 15C, the delay period 1521 may be defined as the time until the first user vacates the lockable storage space 2*b*.

The delay period may be implemented by the guidance means outputting an indication for the user to wait, such as visually and/or audibly outputting the indication. During the delay period, the guidance means may refrain from outputting the location of the next lockable storage space in the sequence. In this way, the user will not be guided to a storage space where an access conflict would occur, thereby preventing overcrowding.

Once the likelihood of an access conflict is below a threshold, in step 1370 the access control system and guidance means may operate as previously described. The access control system may sequentially unlock, for each of the first user and second user, each lockable storage space according to the first and second access sequences respectively, whilst incorporating any determined delays. As the sequence unfolds, the access control system may continually or intermittently monitor the sequence for potential access conflicts arising. Responsively, the first or second access sequences may be rearranged to mitigate the likelihood as described in step 1340. If no rearrangement is possible, or the system is configured to preferentially implement delays, one or more delays may be determined as described in step 1360. The system may therefore flexibly respond to unprecedented potential access conflicts during the unfolding of the sequence.

The following makes reference to FIGS. 2 & 8-10. A storage installation at a given site ("collection site" in the following, referenced 1) may comprise a plurality of lockable storage spaces, arranged either in a single locker bank 10, or in two or more separate locker banks 10 typically grouped conveniently close to one another at the site. Each storage space comprises at least one compartment 12. Additional compartments 12 can be created within a storage space 2 using at least one horizontal, vertical and/or diagonal divider 13 to separate the compartments. The compartments 12 within a storage space 2 may be equal or different in volume and/or shape. Typically, the storage spaces 2 are lockers, i.e. each having a respective lockable door 11; but may also comprise drawers as some items, such as round items, may roll out when a door 11 is opened. The door 11 is typically mounted to the locker bank 10 by a hinge or pivot 21, though any other suitable mounting arrangements, e.g. sliding doors or doors with compound articulations, may also be used; throughout or in any suitable combination. Storage spaces 2 may be equal to each other in size and/or volume, or may be different to each other in size and/or volume.

Typically, the storage spaces 2 are generally box shaped (rectangular/square parallelepiped-like volumes).

The storage spaces 2 need not comprise a conventional door 11, but instead may have an inner member and an outer member which are moveable or slidable with respect to one another about or along a common axis. The inner member and outer member can be a coaxially aligned inner tubular member and outer tubular member, respectively, wherein at least one of the inner tubular member or outer tubular member is rotatable or slidable with respect to the other about or along their shared axis. The inner tubular member is placed within the outer tubular member and each tubular member comprises an opening. The storage space 2 is in an "open" state when the opening of the inner tubular member aligns with the opening of the outer tubular member. The inner tubular member aligns with the opening of the outer tubular member when the opening to access the contents of the storage space 2 is maximised. The storage space 2 is in a "closed" or "partially closed" state when the opening of the inner tubular member is misaligned with the opening of the outer tubular member. The opening of the inner tubular member may be smaller, larger or equivalent to the size of the opening of the outer tubular member. The opening may be an aperture, a cut-out or a space. Any other suitable openable/closable and lockable storage space may be used, e.g. lidded bins and hoppers, bins and hoppers in an enclosing cabinet and which tilt between open and closed positions, etc.

Access to the contents is made available by the storage space 2 going from the "closed" state to the "open" stated. This can be achieved in several ways, one of which is the user 50 manually rotating or sliding the inner member or the outer member. Another way is by using at least one mover, such as an actuator, to slide or move the inner, outer or both members with respect to the other such that access is provided from the aligned openings of the inner member and outer member. Another way is by using a motor to rotate the inner tubular member, outer tubular member or both tubular members with respect to the other such that access is provided from the aligned openings of the inner member and outer member.

In the case of more conventional generally box-shaped storage spaces 2, these may be joined together side by side in the or each locker bank 10, and usually share side walls 30.

Figure 2:
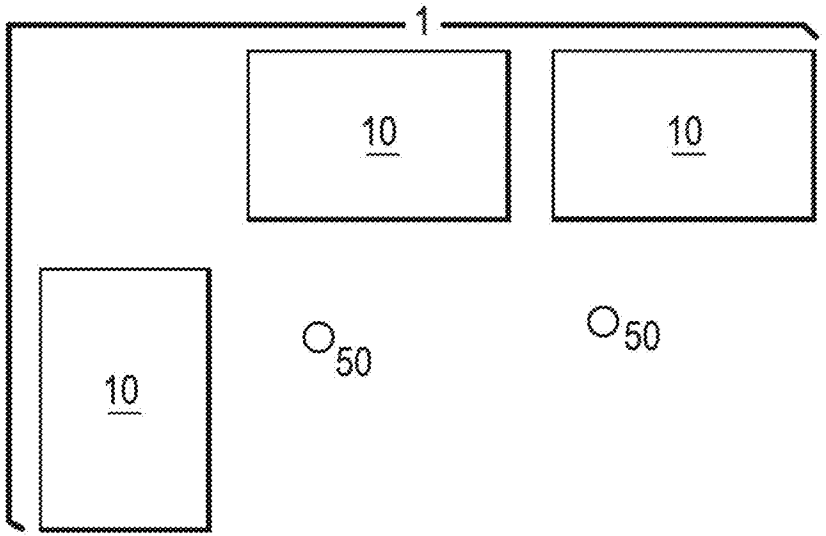
FIG. 2: A schematic plan view of a storage installation comprising three locker banks.

The plurality of lockable storage spaces 2 may be positioned such that they are adjacent to one another. For example, a storage installation 1 may comprise one locker bank 10, wherein a locker bank 10 comprises a plurality of storage spaces 2. Alternatively (as shown in FIG. 2), a storage installation 1 comprises two or more locker banks 10 wherein each locker bank 10 is placed proximate to another.

Figure 8:
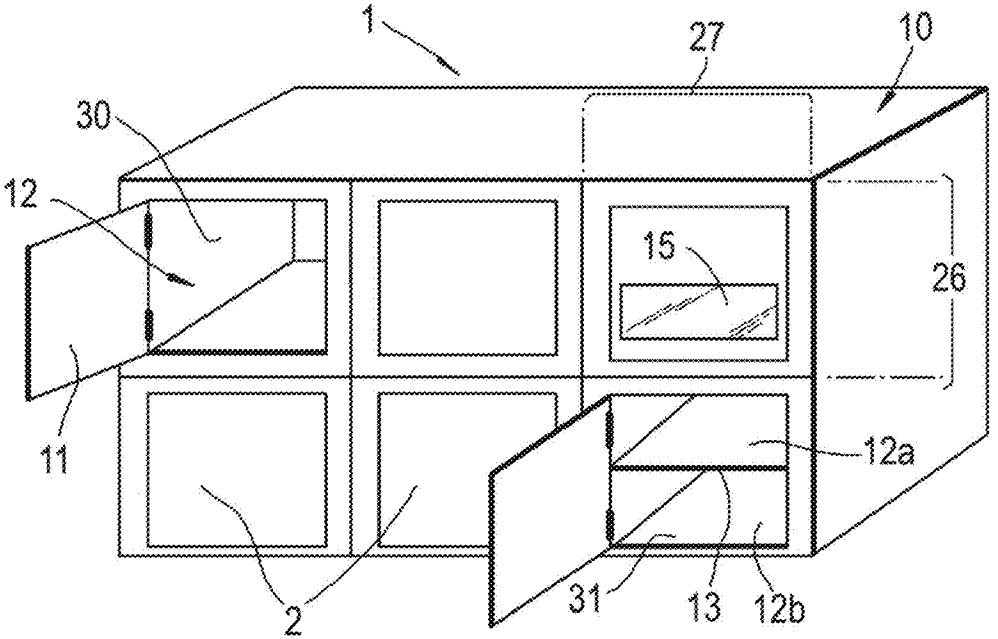
FIG. 8: A schematic perspective view of a locker bank.

FIG. 8 illustrates a locker bank 10 with six storage spaces 2; however a locker bank 10 can be arranged in a multitude of ways. Preferably, a locker bank 10 has two or more storage spaces 2 wherein the two or more storage spaces 2 are arranged in at least one row 26 and/or at least one column 27 in locker bank.

Each compartment 12, 12*a*, 12*b* of the storage space 2 may comprise at least one variable which is independently controllable (as taught in WO2015114331), wherein the variable may be temperature, humidity, other atmospheric composition and/or pressure, for example. A subset of the compartments 12, 12*a*, 12*b* within a storage installation 1 can for example be in controlled to provide a selectable specified condition whilst another subset of the compartments 12, 12*a*, 12*b* within the same storage installation 1 can for example be controlled to provide another selectable specified condition, wherein the selectable specified condition comprises temperature, humidity, other atmospheric condition or composition, pressure etc. Therefore, a user 50 having ordered a variety of goods requiring different storage conditions, e.g. frozen goods and chilled goods, may need to go to two or more separate storage spaces 2 within the storage installation 1 to collect their goods as they will not necessarily be stored together within the same storage space 12. A subset within a storage installation 1 may comprise storage spaces 2 from separate locker banks 10.

Figure 9:
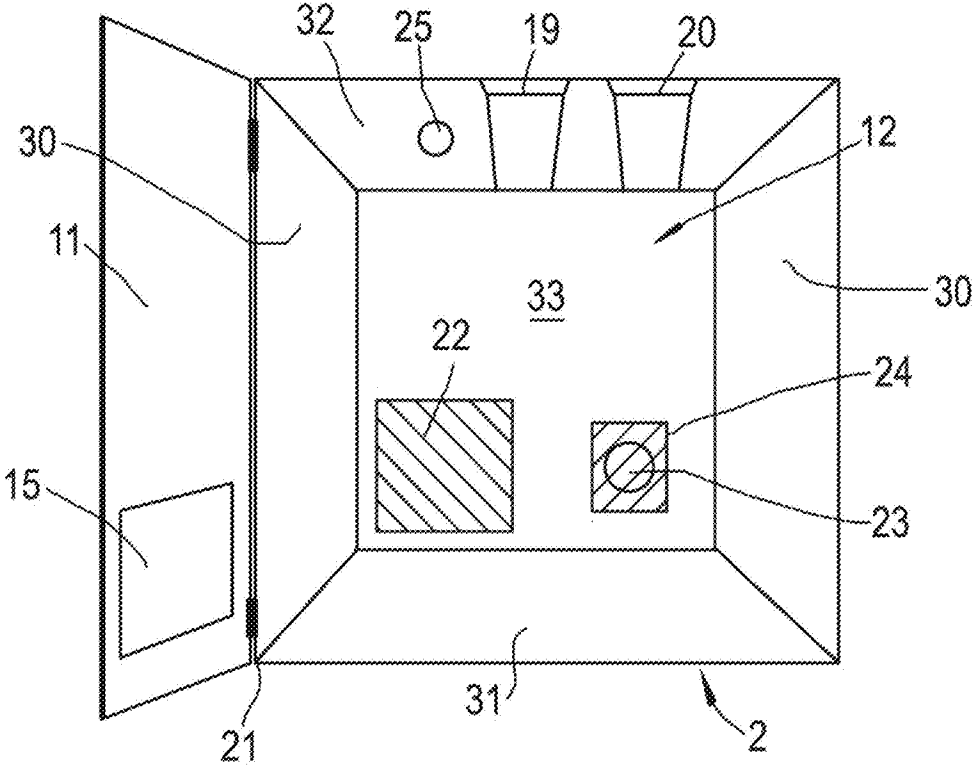
FIG. 9: A schematic view of a storage space within a locker bank.

As best seen in FIG. 9, a compartment 12 may comprise a side wall 30, a lower wall 31, an upper wall 32 and a rear wall 33. In order to prevent items contained within a compartment 12 of storage space 2 from rolling or falling out of the compartment 12 upon opening the door 11 to the storage space 2, the lower wall 31 of at least one storage space may be tilted such that it is declined between the edge nearest the door 11 towards the rear wall 33. The angle of decline is preferably between 0 and 10 degrees from the horizontal plane, more preferably between 0 and 5 degrees from the horizontal plane. Alternatively or additionally a horizontally configured divider 13 which is placed in the storage space 2 to create two compartments 12*a*, 12*b* (see FIG. 8) may also be declined as described above, to prevent items from falling or rolling out of the upper compartment 12*a* created by the divider 13. Additionally or alternatively the lower wall 31 and/or the horizontal divider may comprise a lip or threshold adjacent the opening, for a similar purpose.

FIG. 9 shows an internal view of a storage space 2 with one compartment 12. In this exemplary embodiment, the compartment comprises an air conditioner or dehumidifier 22 for dehumidifying the compartment 12. The dehumidifier 22 can be a water vapour condensing dehumidifier unit and can be placed entirely within the compartment 12, or partially within the compartment 12 and partially on the exterior of the locker bank 10 and/or partially in a gap between storage spaces 2. Alternatively, or additionally, the dehumidifier 22 can be a holder for silica gel or other suitable desiccant, such that the desiccant can be placed in said holder to control local humidity.

A storage space 2, as shown in FIG. 9, may comprise an inlet/outlet 23 for a vacuum pump in order to allow control of the pressure within the storage space 2. A vacuum pump may be coupled with the inlet/outlet 23, wherein the vacuum pump is external to the storage space 2. The inlet/outlet 23 may also have an inlet/outlet cover 24 and/or filter to prevent any items placed within the compartment 12 from being sucked into the inlet/outlet 23. The inlet/outlet 23 may be placed on the rear wall 33 of the compartment. Alternatively, the inlet/outlet 23 may be placed on a upper wall 32, side wall 30 or lower wall 31 if the storage space 2 is placed on an edge of the locker bank 10 such that said upper wall 32, side wall 30 or lower wall 31 is not adjacent to another compartment 12. A pressure equalisation valve or the like may be provided, for connecting the compartment interior to ambient when it is desired to open the compartment door or other access means.

The compartment 12 may comprise interior illumination such as from a light source 20 facilitating collection and inspection of stored items. The light source 20 may be switched on when the door 11 opened or unlocked, and the light source 20 may be switched off when the door 11 is closed or locked. Optionally, the light source 20 may be switched on or off regardless of the state of the door 11 or lock. Further optionally, the light source 20 may be switched on or off remotely regardless of the state of the door 11 or lock. The light source 20 may comprise at least one of an LED light source, a UV light source, a fluorescent light source or an incandescent light source. The light source 20 may be provided anywhere within the compartment 12, preferably on at least one of the walls 30-33. Preferably, the light source 20 is positioned on the upper wall 32 of the compartment.

In case of a fire within at least one compartment 12, the compartment 12 may be equipped with an active fire protection system 19 such as a fire sprinkler system. A fire sprinkler system comprises a water supply system and at least one fire sprinkler. In absence of a fire within a compartment 12, each of the at least one fire sprinklers has a closed-head which is held closed by a heat-sensitive glass or wax bulb, fusible metal alloy link or the like, wherein the glass bulb etc. acts as a plug preventing water from flowing until the ambient temperature around the sprinkler reaches an activation temperature. Once the activation temperature is reached, i.e. there is a fire within the compartment 12, the metal link melts or the heat-sensitive bulb breaks such that the water is no longer prevented from sprinkling onto the fire. Preferably, the active fire protection system 19 is positioned on the upper wall 32. The water supply system may be provided external to the compartment 12, preferably behind the rear wall 33.

The door 11 may comprise a window 15 such that light can be transmitted from the surroundings to within the at least one compartment 12 of the storage space 2. This can be useful if the item(s) in the compartment 12 require light, e.g. plants. The window may be transparent or translucent. The window 26 may be a smart window such that it can dim or undim by using electrochromic glass which can change from light to dark (i.e. transparent/translucent to more or completely opaque), and back again. The change from light to dark of the electrochromic glass may occur on locking or unlocking the door 11 of the storage space 2, or vice versa. In case the goods stored in the compartment 12 comprises a plant, a plant watering system can be fitted into the compartment 12 such that the plant is watered at set intervals or watering can be controlled manually, controlled remotely or programmed.

The at least one locker bank 10 may be fixed to the ground, or it may be made mobile by the use of wheels or castors on its underside. The wheels/castors may be lockable.

The storage installation 1 may also comprise an "SOS" switch or button which allows a user to communicate to a member of staff. Preferably, the switch is a push button. The "SOS" switch, once triggered, will connect, by either wired or wireless means, a user 50 to a member of staff who can assist the user 50. Alternatively, or additionally, the "SOS" function may be operated through a personal communications device 230 such that the user 50 may communicate to the member of staff from their personal communications device 230. The plurality of lockable storage spaces 2 may also be wheelchair friendly by offering storage spaces which are accessible to wheelchair users. At the point of order, a user 50 would need to identify as a wheelchair user. The central control system 101 will then allocate a wheelchair friendly storage space 2 to said user 50. The wheelchair-friendly storage space 2 is typically located on the lowermost row of the locker bank 10 such that wheelchair users can access their ordered goods. In order to comply with the American Disability Act, the required dimensions for wheelchair friendly storage spaces are given. As per Section 308.2.1 of the 2010 ASA Standards for Accessible Design, where forward reach is unobstructed, the high forward reach shall be 1220 mm maximum and the low forward reach shall be 380 mm minimum above the finish floor or ground. As per Section 308.3.1 of the 2010 ASA Standards for Accessible Design, where a clear floor or ground space allows a parallel approach to an element and the side reach is unobstructed, the high side reach shall be 1220 mm maximum and the low side reach shall be 380 mm minimum above the finish floor or ground.

FIG. 11 shows an example of a mobile app for users, in particular the courier or delivery driver, on a personal communications device 230. This mobile app for use by couriers or delivery drivers is referred to as a Delivery Driver App. The Delivery Driver App may register with the access control system (which may be located at the storage installation) by wireless means, such as Bluetooth or Wi-fi. Once the user of the Delivery Driver App is connected to the access control system, the Delivery Driver App may provide a delivery procedure via the personal communications device guiding said user to deliver goods to a subset of lockable storage spaces by at least one guidance means, e.g., but not limited to, any of the guidance means described above.

FIG. 12 shows an example of a mobile app for users, in particular consumers placing and taking delivery of goods orders, on a personal communications device 230. This mobile app for use by consumers is referred to as the Consumer App. The Consumer App may register with the access control system (which may be located at the storage installation) by wireless means, such as Bluetooth or Wi-fi. The Consumer App will navigate the user through the "click and collect" experience. Once a user has registered, such as by scanning a machine-readable medium (FIG. 12A) provided by the Consumer App at an input device, the access control system will consistently "broadcast" both the order number and the next storage space or spaces in the collection sequence. The application will "ignore" the subsequent storage space message if the order number or like identifier does not match that of the user that is using the Consumer App. A user may use a machine-readable medium to open/unlock one of their allocated storage spaces 2. Once the allocated storage space 2 is closed/locked, the Consumer App may then prompt the user to collect their goods from a subsequent allocated storage space by displaying the subsequent allocated storage space on the display screen of the personal communications device as shown in FIGS. 12B & 12C. Optionally, or additionally, the mobile app may prompt the user to collect their goods from a subsequent allocated storage space by voice command via the loudspeaker of the personal communications device or the user's headphones connected to their personal communications device, i.e. the mobile app will output a recorded or synthesised voice message indicating the location of the subsequent storage space allocated to said user 50. Other variants are possible, as described above.

What is claimed is:

1. A secure storage system for multi-user access having a plurality of lockable storage spaces, comprising:

(i) a database for storing at least an allocation of a first subset of the lockable storage spaces to a first user and a second subset of the lockable storage spaces to a second user;

(ii) an access controller configured for granting or denying access to the lockable storage spaces by:

(a) identifying the first user and the second user based on first and second credentials, respectively, (b) identifying the first subset from the database based on the identity of the first user, and the second subset from the database based on the identity of the second user, (c) determining, for the first user, a first access sequence of lockable storage spaces within the first subset, and for the second user, a second access sequence of lockable storage spaces within the second subset in dependence on a likelihood of an access conflict with the first user, (d) determining at least one delay period for at least one of the first access sequence and the second access sequence if the likelihood of the access conflict remains above a predetermined threshold, and incorporating the at least one delay period into the at least one of the first access sequence and the second access sequence, and (e) sequentially unlocking, for each of the first user and second user, each lockable storage space of the first and second subsets according to the first and second access sequences, respectively, in a manner such that the first user is enabled access to at least one lockable storage space of the first subset at the same time as the second user is enabled access to at least one lockable storage space of the second subset; and (iii) guidance means configured to contemporaneously guide the first user along the first access sequence and the second user along the second access sequence.

2. The secure storage system of claim 1 wherein determining the likelihood of an access conflict comprises, for each allocated lockable storage space of at least one of the first and second subsets:

determining a likelihood of a neighboring lockable storage space of the other subset being unlocked generally contemporaneously to the allocated lockable storage space.

3. The secure storage system of claim 2, wherein the neighboring lockable storage space comprises a lockable storage space of the other subset within a predetermined distance of the allocated lockable storage space.

4. The secure storage system of claim 2, wherein:

the plurality of lockable storage spaces are arranged in a plurality of columns, and the neighboring lockable storage space comprises a lockable storage space of the other subset within a same column as the allocated lockable storage space.

5. The secure storage system of claim 1 wherein the access controller is configured to determine the second access sequence to minimize the likelihood of an access conflict.

6. The secure storage system of claim 1 wherein the access controller is configured to determine successive portions of the second access sequence after the guidance means has guided the second user to at least one locker, and at least one portion of the second access sequence is determined in dependence on the likelihood of an access conflict with the first user.

7. The secure storage system of claim 1 wherein the access controller is configured to, as the first or second user is guided, rearrange the remaining first or second access sequence to minimize the likelihood of an access conflict.

8. The secure storage system of claim 1, wherein the guidance means comprises at least one output device for communicating the first and second access sequence to the first and second user respectively.

9. The secure storage system of claim 8, wherein the at least one output device comprises at least one of: a display screen, a speaker, earphones, a printer, a voice output communication aid, a navigation system, a scanner station, a personal communications device, an access control console, a path projection system, a customer information display panel, a lights-based system, a path projection system, a head-mounted system, a virtual assistant, and/or a locker number display system.

10. The secure storage system of claim 8, wherein the at least one access control console comprises two or more access control consoles, at least two of the access control consoles communicating the first and second access sequence respectively.

11. A computer-implemented method for granting or denying access to a plurality of lockable storage spaces including a first subset of the lockable storage spaces allocated to a first user and a second subset of the lockable storage spaces allocated to a second user, comprising:

(i) identifying the first user and the second user based on first and second credentials, respectively, (ii) identifying the first subset from a database based on the identity of the first user, and the second subset from a database based on the identity of the second user, (iii) determining, for the first user, a first access sequence of lockable storage spaces within the first subset, and for the second user, a second access sequence of lockable storage spaces within the second subset in dependence on a likelihood of an access conflict with the first user, (iv) determining at least one delay period for at least one of the first access sequence and the second access sequence if the likelihood of the access conflict remains above a predetermined threshold, and incorporating the at least one delay period into the at least one of the first access sequence and the second access sequence, (v) sequentially unlocking, for each of the first user and second user, each lockable storage space of the first and second subsets according to the first and second access sequences, respectively, in a manner such that the first user is enabled access to at least one lockable storage space of the first subset at the same time as the second user is enabled access to at least one lockable storage space of the second subset; and (vi) contemporaneously guiding the first user along the first access sequence and the second user along the second access sequence.

12. The method of claim 11 wherein determining the likelihood of an access conflict comprises, for each allocated lockable storage space of at least one of the first and second subsets:

determining a likelihood of a neighboring lockable storage space of the other subset being unlocked generally contemporaneously to the allocated lockable storage space.

13. A non-transitory computer readable medium comprising computer readable instruction that, when executed by a processor, cause performance of the method of claim 11.

14. A computer-implemented method for granting or denying access to a plurality of lockable storage spaces including a first subset of the lockable storage spaces allocated to a first user and a second subset of the lockable storage spaces allocated to a second user, comprising:

(i) identifying the first user and the second user based on first and second credentials, respectively, (ii) identifying the first subset from a database based on the identity of the first user, and the second subset from a database based on the identity of the second user, (iii) determining, for the first user, a first access sequence of lockable storage spaces within the first subset, and for the second user, a second access sequence of lockable storage spaces within the second subset so as to reduce or minimize a likelihood of an access conflict, wherein the likelihood of an access conflict is determined according to a likelihood of the first user opening one of the lockable storage spaces of the first subset contemporaneously with the second user opening one of the lockable storage spaces of the second subset that is with a defined proximity of the one of the lockable storage spaces of the first subset, (iv) sequentially unlocking, for each of the first user and second user, each lockable storage space of the first and second subsets according to the first and second access sequences, respectively, in a manner such that the first user is enabled access to at least one lockable storage space of the first subset at the same time as the second user is enabled access to at least one lockable storage space of the second subset; and (vi) contemporaneously guiding the first user along the first access sequence and the second user along the second access sequence.

* * * * *